US006114103A

United States Patent [19]

Friday et al.

[11] Patent Number: 6,114,103

[45] Date of Patent: Sep. 5, 2000

[54] PHOTOGRAPHIC RECORDING MATERIAL FOR ACCELERATED DEVELOPMENT

[75] Inventors: James A. Friday, Rochester; Sharon R. Lunt, Webster, both of N.Y.; Scott C. Sutton, San Diego, Calif.

[73] Assignee: Eastman Kodak Company, Rochester, N.Y.

[21] Appl. No.: 09/224,230

[22] Filed: Dec. 30, 1998

[51] Int. Cl.[7] ..... G03C 7/305

[52] U.S. Cl. ..... 430/546; 430/549; 430/551; 430/552; 430/955

[58] Field of Search ..... 430/544, 549, 430/551, 552, 955

[56] References Cited

U.S. PATENT DOCUMENTS

| | | | |
|---|---|---|---|
| 4,859,578 | 8/1989 | Michno et al. | 430/544 |
| 4,912,025 | 3/1990 | Platt et al. | 430/544 |
| 5,605,786 | 2/1997 | Saito et al. | 430/553 |

FOREIGN PATENT DOCUMENTS

| | | | |
|---|---|---|---|
| 310125 | 4/1989 | European Pat. Off. | G03C 7/26 |
| 3-209240 | 9/1991 | Japan | G03C 7/305 |

*Primary Examiner*—Janet Baxter
*Assistant Examiner*—Amanda C. Walke
*Attorney, Agent, or Firm*—Sarah Meeks Roberts

[57] ABSTRACT

This invention relates to a photographic element comprising a support and at least two silver halide emulsion layers wherein at least one emulsion layer contains an electron transfer agent releasing compound represented by the formula:

$$CAR—(L)_n—ETA$$

wherein:

CAR is a carrier moiety which is capable of releasing —(L)n—ETA on reaction with oxidized developing agent;

L is a divalent linking group, n is 0, 1 or 2; and

ETA is a releasable 1-aryl-3-pyrazolidinone electron transfer agent having a calculated log partition coefficient (c log P) greater than or equal to 2.40 bonded to L or CAR through either the nitrogen atom in the 2-position or the oxygen attached to the 3-position of the pyrazolidinone ring; and at least one soluble mercaptan releasing compound.

27 Claims, No Drawings

PHOTOGRAPHIC RECORDING MATERIAL FOR ACCELERATED DEVELOPMENT

FIELD OF THE INVENTION

This invention relates to a silver halide photographic element containing a combination of a compound that releases an electron transfer agent (ETARC) capable of selective development acceleration for improved photographic imaging and a soluble mercaptan releasing compound (SMRC).

BACKGROUND OF THE INVENTION

It is a long-standing objective that color photographic origination materials maximize the overall response to light while maintaining the lowest possible granularity. Increased photographic sensitivity to light (commonly referred to as photographic speed) allows for improved images captured under low light conditions or improved details in the shadowed regions of the image. In general, the overall light sensitivity provided by the light sensitive silver halide emulsions in such systems is determined by the size of the emulsions. Larger emulsions capture more light. Large silver grains or silver halide grains having high iodide content, generally develop at a slower rate than emulsions having smaller grains or lower iodide content. Upon development, the captured light is ultimately converted into dye deposits which constitute the reproduced image. However, the granularity expressed by these dye deposits is directly proportional to the grain size of the silver halide emulsion. Thus, larger silver halide emulsion grains have higher sensitivity to light but also tend to have higher granularity in the reproduced image. It has been a long-standing problem to provide materials which maximize the response to light of a silver halide emulsion for any given grain size.

Customers continue to demand faster products with improved photographic performance. The sensitivity of widely used silver halide photographic materials has increased over the years from an ISO sensitivity of 100 to an ISO sensitivity of greater than 1000. Methods to accelerate development of exposed silver halide grains, which enable higher photographic response with smaller silver halide grains and/or lower granularity, have been realized. For example, U.S. Pat. No. 4,912,025 describes the release of electron transfer agents (ETAs) for development acceleration without a concomitant granularity and fog increase. These type of compounds are commonly referred to as electron transfer agent releasing couplers or ETARCs. More recently, U.S. Pat. No. 5,605,786 describes a method of imagewise release of an ETA where an —O—CO—$(T)_n$—(ETA) group is attached at the coupling-off site of the ETARC. In addition, U.S. Pat. No. 4,859,578 describes 1-arly-3-pyrazolidinone ETAs in combination with a SMRC.

The inventors herein have found that the disadvantage of ETARC compounds used previously is that once released, the ETA fragment migrates out of the layer in which it was coated. This undesired movement of the ETA creates unwanted dye density in the adjacent layer as a function of development of the primary layer and is commonly referred to as wrong way interimage. Wrong way interimage can lead to inaccurate or undesirable color reproduction of the recorded image. The photographic industry continues to need new tools to increase speed and minimize granularity without causing other deleterious consequences.

SUMMARY OF THE INVENTION

This invention provides a photographic element comprising a support and at least two silver halide emulsion layers wherein at least one emulsion layer contains an electron transfer agent releasing compound represented by the formula:

$$CAR—(L)_n—ETA$$

wherein:

CAR is a carrier moiety which is capable of releasing —(L)n—ETA on reaction with oxidized developing agent;

L is a divalent linking group, n is 0, 1 or 2; and

ETA is a releasable 1-aryl-3-pyrazolidinone electron transfer agent having a calculated log partition coefficient (c log P) greater than or equal to 2.40 bonded to L or CAR through either the nitrogen atom in the 2-position or the oxygen attached to the 3-position of the pyrazolidinone ring; and at least one soluble mercaptan releasing compound.

The photographic elements of this invention have reduced wrong-way interimage effects due to the decreased migration of the ETA released by the ETARC. Further, the photographic elements of this invention have increased speed without the concomitant increase in granularity. The combination of the ETARCS and SMRCs utilized herein reduce the wrong-way interimage effect without compromising the performance of the photographic element.

DETAILED DESCRIPTION OF THE INVENTION

The ETARCS utilized in the photographic elements of the invention are represented by the formula $$CAR—(L)_n—ETA.$$

ETA is a 1-aryl-3-pyrazolidinone derivative having a calculated log partition coefficient (c log P) greater than 2.40 using MedChem v3.54.(Medicinal Chemistry Project, Pomona College, Claremont, Calif., 1987). The ETA is released from —$(L)_n$— and becomes an active electron transfer agent capable of accelerating development under processing conditions used to obtain the desired dye image.

On reaction with oxidized developing agent during processing, the CAR moiety releases the —$(L)_n$—ETA fragment which is capable of releasing an electron transfer agent. The electron transfer agent participates in the color development process to increase the rate of silver halide reduction and color developer oxidation resulting in enhanced detection of exposed silver halide grains and the consequent improved image dye density. The inventors herein have discovered that one of the problems with ETARC technology is associated with the mobility of the released ETA in the photographic coating. The ETA must move out of the hydrophobic environment from which it is released and become associated with the silver halide emulsion to accelerate development of exposed silver halide grains. On the other hand, the ETA must be slow to migrate into an adjacent light sensitive layer because the ETA will accelerate development in the adjacent layer as a function of release in the originating layer. This is achieved by utilizing an ETA with a calculated log partition coefficient (c log P) greater than or equal to 2.40 as described above. Preferably the c log P is between and includes 2.40 and 3.50.

The electron transfer agent pyrazolidinones that have been found to be useful in providing development increases are derived from compounds generally of the type described in U.S. Pat. Nos. 4,209,580; 4,463,081; 4,471,045; and 4,481,287 and in published Japanese patent application Ser. No. 62-123,172. Such compounds comprise a 3-pyrazolidinone structure having an unsubstituted or a substituted aryl group in the 1-position. Preferably these compounds have one or more alkyl groups in the 4- or 5-positions of the pyrazolidinone ring.

Preferred electron transfer agents suitable for use in this invention are represented by structural formulas I and II:

I

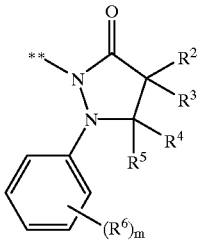

II

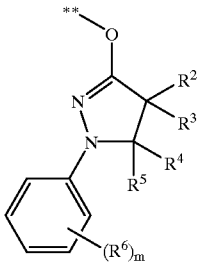

** denotes point of attachment to CAR-$(L)_n$-;

$R^2$ and $R^3$ each independently represent hydrogen, a substituted or unsubstituted alkyl group having from 1 to 12 carbon atoms, $CH_2OR^7$ or $CH_2OC(O)R^7$ where $R^7$ can be a substituted or unsubstituted alkyl, aryl or a heteroatom containing group. When $R^2$ and $R^3$ are alkyl, $CH_2OR^7$ or $CH_2OC(O)R^7$ groups, and $R^7$ is a substituted or unsubstituted alkyl or aryl group, it is preferred that $R^2$ and $R^3$ comprise from 3 to 8 carbon atoms. When $R^7$ is a heteroatom containing group it is preferred that $R^2$ and $R^3$ comprise from 4 to 12 carbon atoms. $R^7$ may contain, for example, a morpholino, imidazole, triazole or tetrazole group, or a sulfide or ether linkage.

$R^4$ and $R^5$ each independently represent hydrogen, a substituted or unsubstituted alkyl group having from 1 to 8 carbon atoms or a substituted or unsubstituted aryl group having from 6 to 10 carbon atoms. Preferably $R^4$ and $R^5$ each represent hydrogen.

$R^6$, which may be present in the ortho, meta or para positions of the aromatic ring, is any substituent which does not interfere with the required log partition coefficient or the functionality of the ETARC. In one embodiment $R^6$ independently represents hydrogen, halogen, a substituted or unsubstituted alkyl group having from 1 to 8 carbon atoms, a substituted or unsubstituted alkoxy group having from 1 to 8 carbon atoms, or an amido, sulfonamido, ester, cyano, sulfone, carbamoyl, uriedo group, or a heteroatom containing group or ring. Preferably $R^6$ is hydrogen, halogen, a substituted or unsubstituted alkyl group having from 1 to 8 carbon atoms or a substituted or unsubstituted alkoxy group having from 1 to 8 carbon atoms. m is 0 to 5. When m is greater than 1, the $R^6$ substituents can be the same or different or can be taken together to form a carbocyclic or heterocyclic ring; and Especially preferred releasable electron transfer agents, suitable for use in this invention are presented in Table I, with $R^4$ and $R^5$ being hydrogen:

TABLE I

| ETA No. | $R^2$ | $R^3$ | $R^6$ |
|---|---|---|---|
| 1 | $CH_3$ | $CH_2OC(O)iPr$ | H |
| 2 | $CH_3$ | $CH_2OC(O)tBu$ | H |
| 3 | $CH_3$ | $CH_2OC(O)Et$ | p-$CH_3$ |
| 4 | $CH_3$ | $CH_2OC(O)Et$ | 3,4-dimethyl |
| 5 | H | $CH_2OC_4H_9$-n | p-$OCH_3$ |
| 6 | $CH_3$ | $CH_2OC(O)CH_2$—O—$(CH_2)_2S(CH_2)_2SMe$ | H |

The amount of ETARC that can be employed with this invention can be any concentration that is effective for the intended purpose. A possible range for the compound to be employed is at a concentration from 6 $\mu$mole/$m^2$ to 500 $\mu$mole/$m^2$. A preferred concentration range is 20 $\mu$mole/$m^2$ to 140 $\mu$mole/$m^2$.

The ETA is attached to the coupler at a position that will cause the ETA to be inactive until released. The point of attachment of the ETA to the CAR or to the CAR—$(L)_n$— linking is through either the nitrogen atom in the 2-position or the oxygen attached to the 3-position of the pyrazolidinone ring, as shown for structures I or II. Such attachment inactivates the ETA so that it is unlikely to cause undesirable reactions during storage of the photographic material. However, the oxidized developer formed in an imagewise manner as a consequence of silver halide development reacts with the CAR moiety to lead to the cleavage of the bond between the CAR and L. L undergoes further reaction to release the active ETA moiety.

The linking group —$(L)_n$— is employed to provide for controlled release of the ETA moiety from the coupler moiety so that the effect of accelerated silver halide development can be quickly attained. L represents a divalent linking group which is both a good leaving group and allows release of the ETA without a long delay. n is 0, 1 or 2. L is not an —O—CO— group. Various types of known linking groups can be used. These include quinone methide linking groups such as are disclosed in U.S. Pat. No. 4,409,323; pyrazolonemethide linking groups such as are disclosed in U.S. Pat. No. 4,421,845; and intramolecular nucleophillic displacement type linking groups such as are disclosed in U.S. Pat. No. 4,248,962. In one suitable embodiment L is a group such as

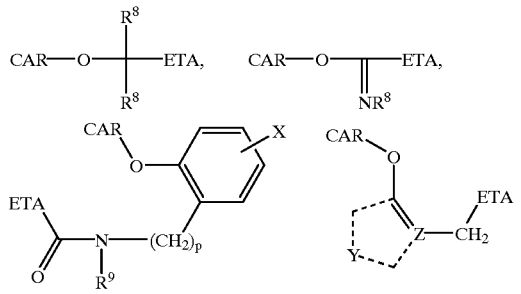

-continued

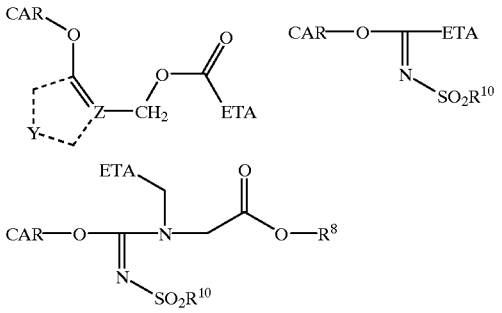

wherein each $R^8$ can independently be hydrogen, a substituted or unsubstituted alkyl group of 1 to 12 carbon atoms or a substituted or unsubstituted aryl group of 6 to 10 carbon atoms. More preferably $R^8$ is a substituted or unsubstituted alkyl group of 1 to 4 carbon atoms. $R^9$ is a substituted or unsubstituted alkyl group of from 1 to 20 carbon atoms, preferably of from 1 to 4 carbon atoms, or a substituted or unsubstituted aryl group of from 6 to 20 carbon atoms, preferably of from 6 to 10 carbon atoms. X is an $—NO_2$, —CN, sulfone, sulfonamide, halogen or alkoxycarbonyl group and p is 0 or 1.

Y represents the atoms necessary to form is a substituted or unsubstituted carbocyclic aromatic ring, or a substituted or unsubstituted heterocyclic aromatic ring. Preferably Y forms a carbocyclic aromatic ring having 6 to 10 carbon atoms or a 5-membered heterocyclic aromatic ring. Suitable heterocyclic rings include pyrazoles, imidazoles, triazoles, pyrazolotriazoles etc. $R^{10}$ is a substituted or unsubstituted alkyl or aryl group. Z is a carbon or nitrogen atom.

Particularly suitable linking groups are represented by the formulas below:

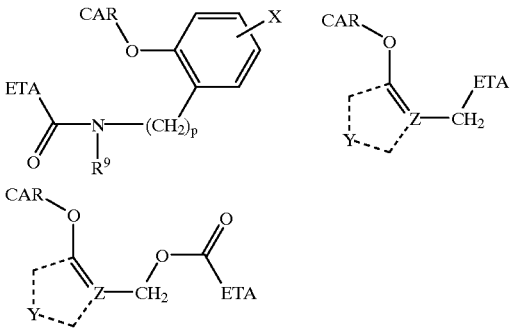

wherein Y represents the atoms necessary to form a substituted or unsubstituted phenyl ring, Z is a carbon atom and $R^9$ and p are as defined above. Typical useful linking groups include:

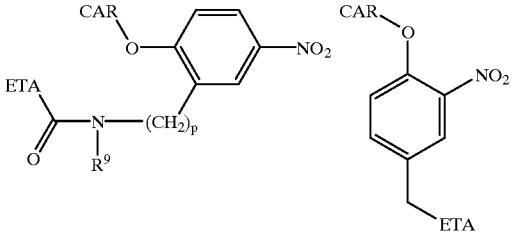

-continued

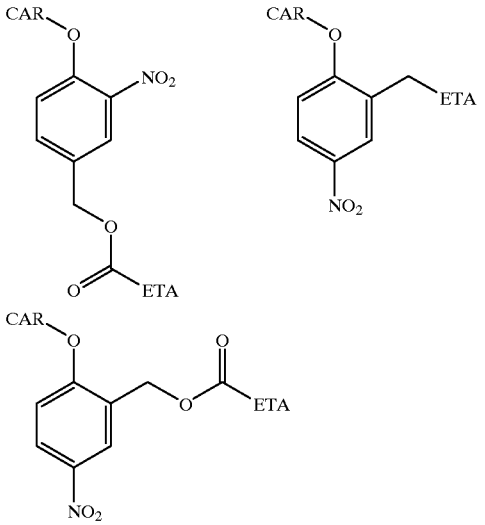

where $R^9$ is as defined above and p is 0 or 1.

CAR is a carrier moiety that is capable of releasing $—(L)_n—ETA$ on reaction with oxidized developing agent. In a preferred embodiment CAR is a coupler moiety that can release $—(L)_n—ETA$ from the coupling site during reaction with oxidized primary amine color developing agent. CAR carriers that are triggered by reaction with oxidized developing agent are capable of releasing a photographically useful group (PUG) and are particularly well-known in development inhibitor release (DIR) technology where the PUG is a development inhibitor. Typical references to hydroquinone type carriers are U.S. Pat. Nos. 3,379,529, 3,297,445, and 3,975,395. U.S. Pat. No. 4,108,663 discloses similar release from aminophenol and aminonaphthol carriers, while U.S. Pat. No. 4,684,604 features PUG-releasing hydrazide carriers. All of these may be classified as redox-activated carriers for PUG release.

A far greater body of knowledge has been built up over the years on carriers in which a coupler releases a PUG upon condensation with an oxidized primary amine color developing agent. These can be classified as coupling-activated carriers. Representative are U.S. Pat. Nos. 3,148,062, 3,227,554, 3,617,291, 3,265,506, 3,632,345, and 3,660,095.

The coupler from which the electron transfer agent pyrazolidinine moiety is released, includes couplers employed in conventional color-forming photographic processes that yield colored products based on reactions of couplers with oxidized color developing agents. The couplers can also yield colorless products on reaction with oxidized color developing agents. The couplers can also form dyes that are unstable and which decompose into colorless products. Further, the couplers can provide dyes that wash out of the photographic recording materials during processing. Such couplers are well known to those skilled in the art.

The coupler can be unballasted or ballasted with an oil-soluble or fat-tail group. It can be monomeric, or it can form part of a dimeric, oligomeric or polymeric coupler in which case more than one ETA moiety or $—(L)_n—ETA$ moiety can be contained in the ETA releasing compound.

Many coupler kinds are known. The dyes formed therefrom generally have their main absorption in the red, green, or blue regions of the visible spectrum. For example, couplers which form cyan dyes upon reaction with oxidized color developing agents are described in such representative patents and publications as: U.S. Pat. Nos. 2,772,162; 2,895, 826; 3,002,836; 3,034,892; 2,474,293; 2,423,730; 2,367,531; 3,041,236; and 4,333,999; and "Farbkuppler: Eine Literaturubersicht," published in Agfa Mitteilungen, Band III, pp. 156–175 (1961). In the coupler structures shown below, the unsatisfied bond indicates the coupling position to which —$(L)_n$—ETA may be attached.

Preferably such couplers are phenols and naphthols that give cyan dyes on reaction with oxidized color developing agent at the coupling position, i.e. the carbon atom in the 4-position of the phenol or naphthol. Structures of such preferred cyan couplers are:

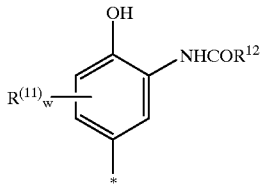

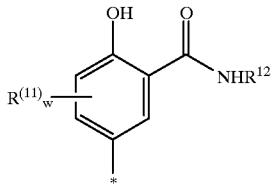

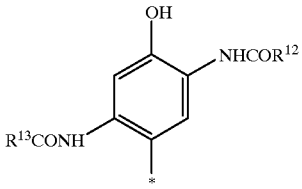

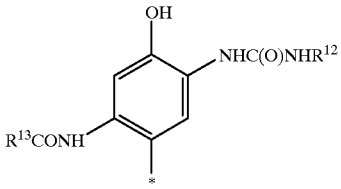

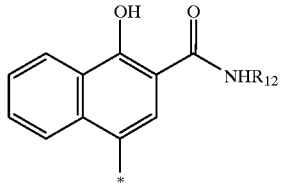

* denotes link to —$(L)_n$—ETA where $R^{12}$ and $R^{13}$ are a ballast group, a hydrogen, or a substituted or unsubstituted alkyl or aryl group, $R^{11}$ is a halogen atom, an alkyl group having from 1 to 4 carbon atoms or an alkoxy group having from 1 to 4 carbon atoms, and w is 1 or 2. Generally $R^{12}$ and $R^{13}$ are groups having less than 20 carbon atoms.

Couplers that form magenta dyes upon reaction with oxidized developing agent are described in such representative patents and publications as: U.S. Pat. Nos. 2,600,788; 2,369,489; 2,343,703; 2,311,082; 3,824,250; 3,615,502; 4,076,533; 3,152,896; 3,519,429; 3,062,653; 2,908,573; 4,540,654; and "Farbkuppler: Eine Literaturubersicht," published in Agfa Mitteilungen, Band III, pp. 126–156 (1961).

Preferably, such couplers are pyrazolones and pyrazolotriazoles that form magenta dyes upon reaction with oxidized developing agents at the coupling position, i.e. the carbon atom in the 4-position for pyrazolones and the 7-position for pyrazolotriazoles. Structures of such preferred magenta coupler moieties are:

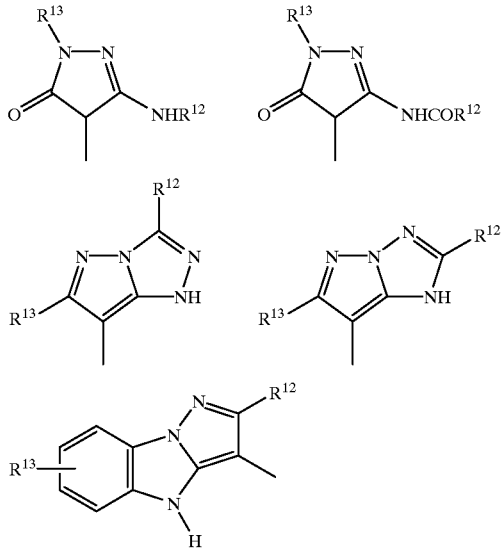

wherein $R^{12}$ and $R^{13}$ are defined above. $R^{13}$ for pyrazolone structures is typically a phenyl group or a substituted or unsubstituted phenyl group, such as, for example, 2,4,6-trihalophenyl. For the pyrazolotriazole structures $R^{13}$ is typically alkyl or aryl.

Couplers that form yellow dyes on reaction with oxidized color developing agent are described in such representative patents and publications as: U.S. Pat. Nos. 2,875,057; 2,407,210; 3,265,506; 2,298,443; 3,048,194; and 3,447,928; and "Farbkuppler: Eine Literaturubersicht," published in Agfa Mitteilungen, Band III, pp. 112–126 (1961).

Preferably, such yellow dye-forming couplers are acylacetamides, such as benzoylacetanilides and pivalylacetanilides. These couplers react with oxidized developing agent at the coupling position, i.e. the active methylene carbon atom. Structures of such preferred yellow couplers are:

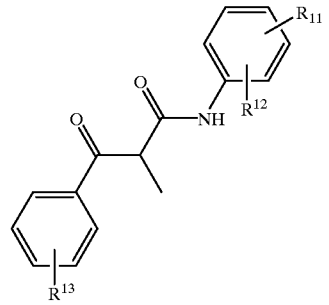

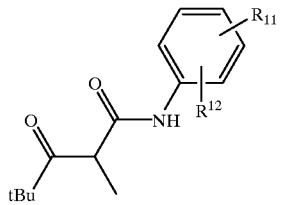

where $R^{12}$ and $R^{13}$ are defined above and can also be alkoxy, alkoxycarbonyl, alkanesulfonyl, arenesulfonyl, aryloxycarbonyl, carbonamido, carbamoyl, sulfonamido, or sulfamoyl. $R^{11}$ is hydrogen or one or more halogen, lower alkyl, (i.e. methyl, ethyl), lower alkoxy (i.e. methoxy, ethoxy), or a ballast (i.e., alkoxy of 16 to 20 carbon atoms) group.

Couplers that form colorless products upon reaction with oxidized color developing agent are described in such representative patents as: U.K. Patent No. 861, 138 and U.S. Pat. Nos. 3,632,345; 3,928,041; 3,958,993 and 3,961,959. Preferably, such couplers are cyclic carbonyl containing compounds that form colorless products on reaction with oxidized color developing agent and have the L group attached to the carbon atom in the α-position with respect to the carbonyl group. Structures of such preferred couplers are:

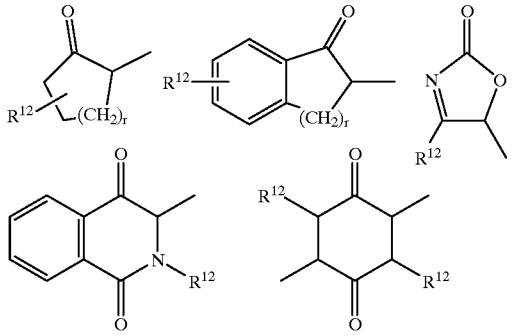

where $R^{12}$ is defined as above, and r is 1 or 2.

It will be appreciated, depending on the particular coupler moiety, or the particular developing agent, or the type of processing, the reaction product of the coupler and oxidized color developing agent can be: (1) colored and non-diffusible, in which case it may not be removed during processing from the location where it is formed; (2) colored and diffusible, in which case it may be removed during processing from the location where it is formed or allowed to migrate to a different location; or (3) colorless and diffusible or non-diffusible, in which case it will not contribute to image density.

Especially preferred structures for CAR—$(L)_n$—ETA are compounds E-1 through E-12, E-15 and E-17. Compounds C-1, C-2 and C-3 are comparative compounds.

E-1

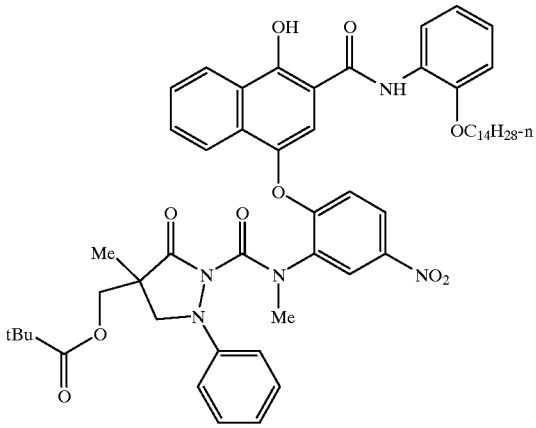

-continued

E-2

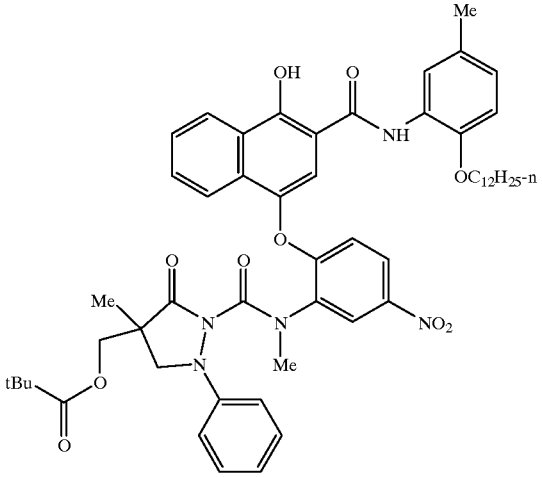

E-3

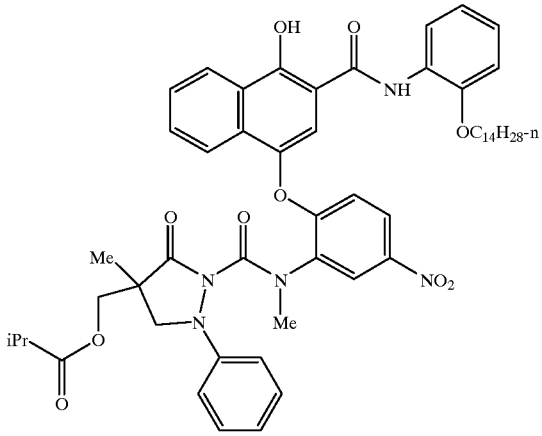

E-4

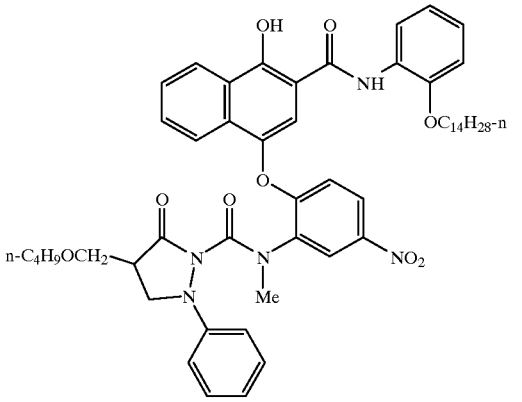

-continued
E-5
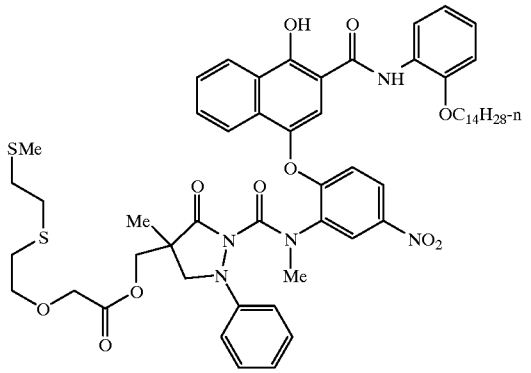
E-6
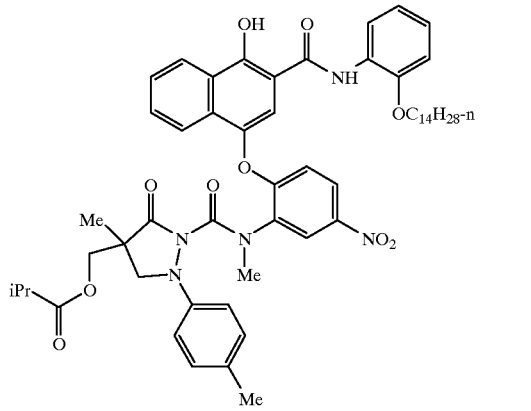
E-7
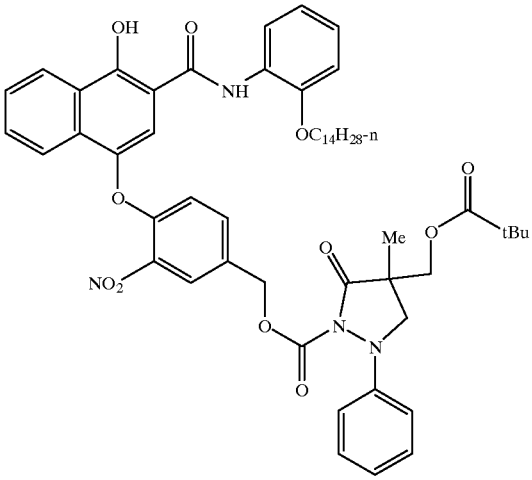
-continued
E-9
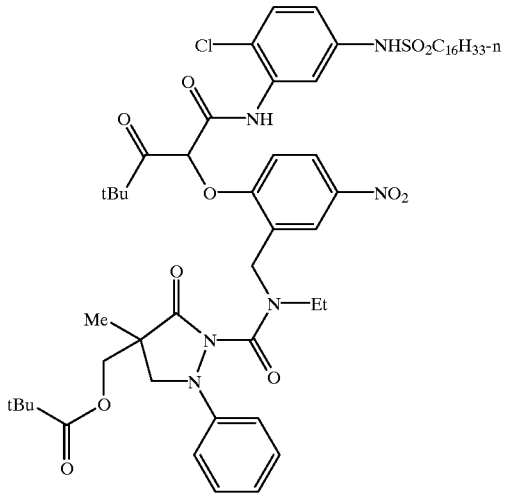
E-10
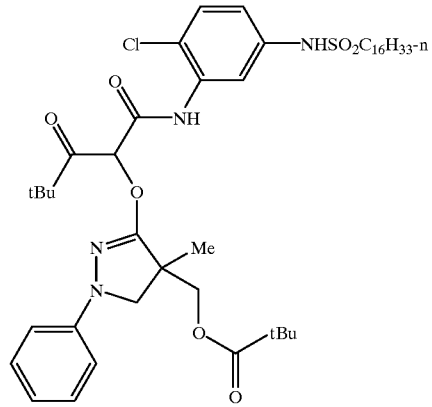
E-11
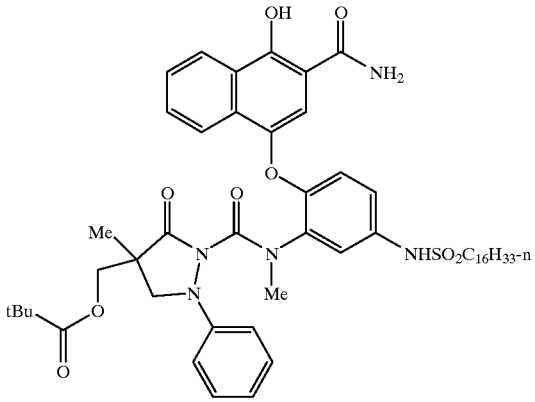

-continued
E-12
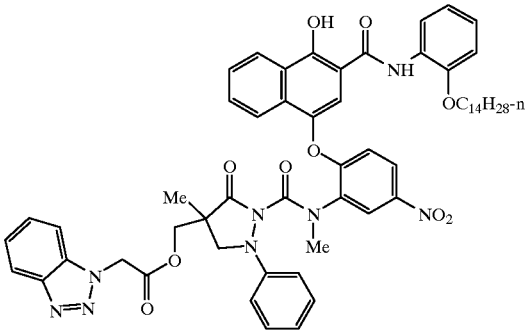
E-15
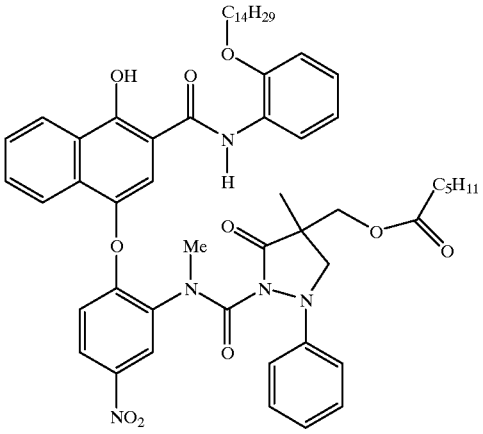
E-17
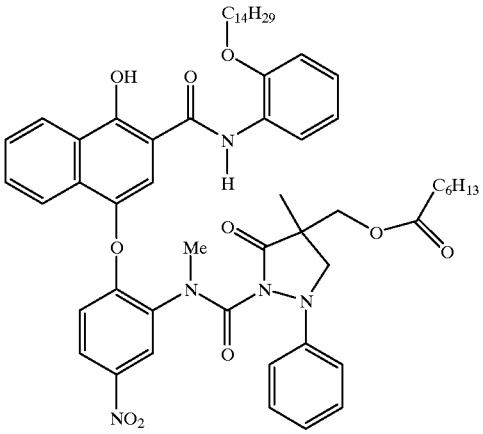
-continued
C-1
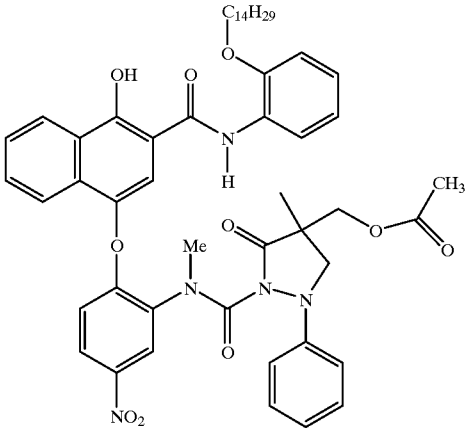
C-2
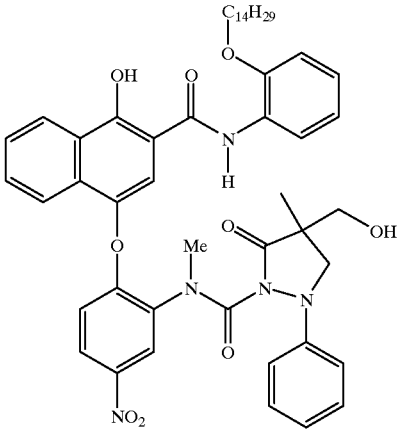
C-3
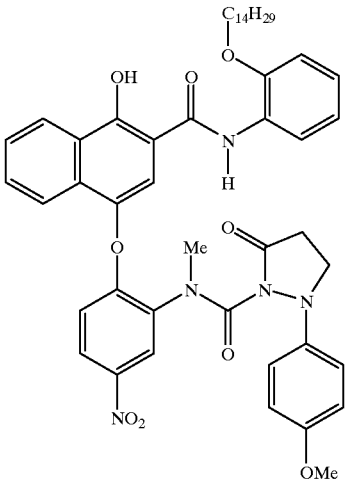

The SMRC compounds utilized in the photographic elements of the invention are soluble mercaptan releasing compounds. In one suitable embodiment the compounds have the general formula A—$(L)_n$—S—R—$(SOL)_i$. A is a coupling moiety which upon reaction with oxidized developer releases —$(L)_n$—S—R—SOL and is as further defined above for CAR. L is an optional releasing or timing group which is cleaved from A by reaction with oxidized developer and undergoes subsequent reaction or decomposition to release —S—R—SOL and n is 0, 1 or 2. In one preferred embodiment n is 0.

R is an alkyl group or aryl group which contains eight or less carbon atoms or a 5 or 6-membered heterocyclic ring. When R is a heterocyclic ring, preferably at least one heteroatom is a nitrogen. More preferably R is an alkyl group which contains eight or less carbon atoms, and most preferably four or less carbon atoms. SOL is a water solubilizing group, for example a carboxy group, and i is 1, 2 or 3.

Non limiting examples of SMRC compounds which may be useful with the ETARCs described above are shown in EP 193389 and U.S. Pat. Nos. 4,861,701; 4,959,299; 4,912,024; 5,300,406 and 5,358,828 all of which are incorporated herein by reference. Often these compounds are described as bleach accelerator releasing couplers. It is also possible to release the same bleach accelerators from materials other than couplers by imagewise means that do not involve direct coupling with oxidized developer; for example, see U.S. Pat. No. 4,684,604 or by non-imagewise means, for example see U.S. Pat. Nos. 4,923,784; 4,865,956; and 5,019,492. Specific examples are shown below in S-1 to S-24.

S-1

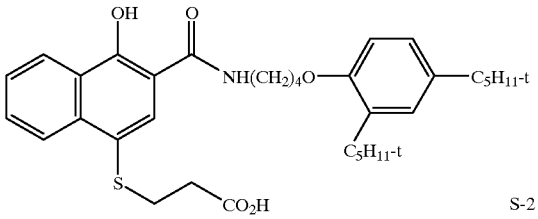

S-2

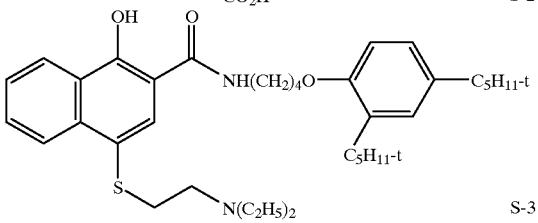

S-3

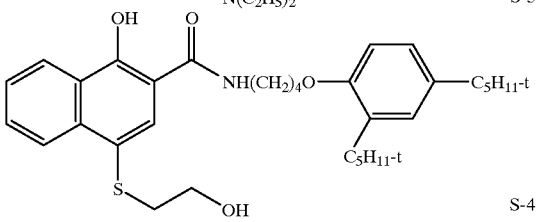

S-4

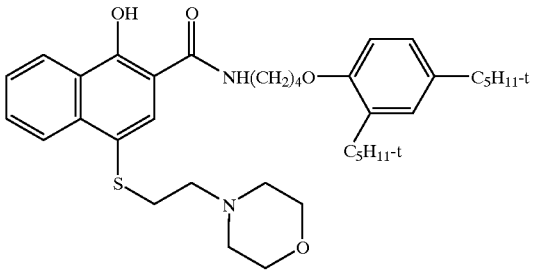

-continued

S-5

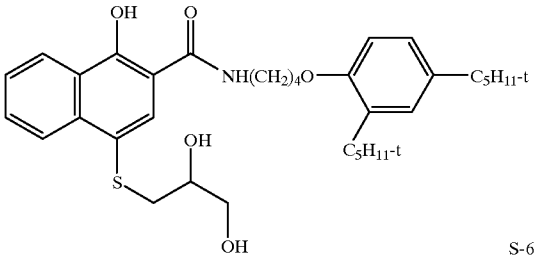

S-6

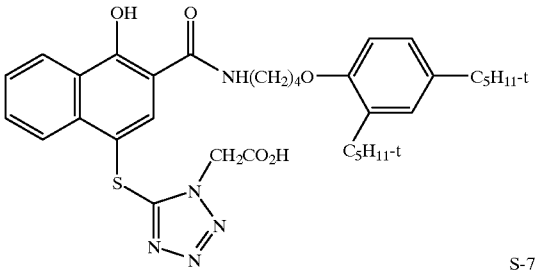

S-7

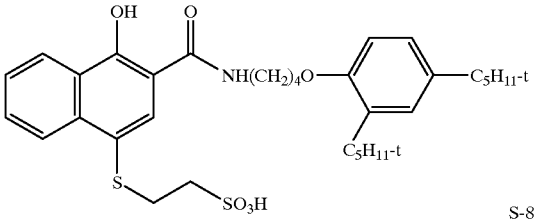

S-8

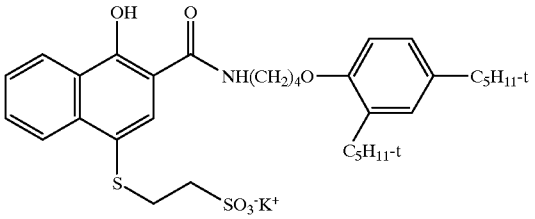

S-9

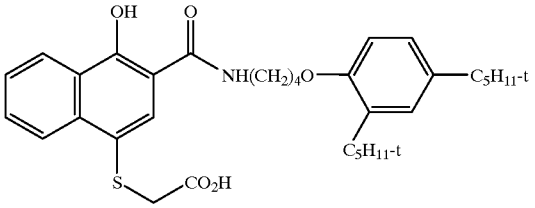

S-10

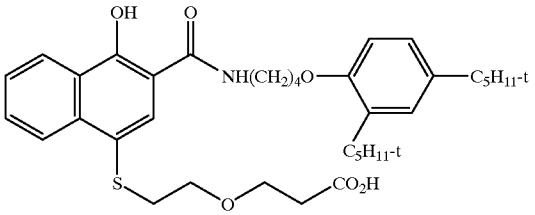

S-11

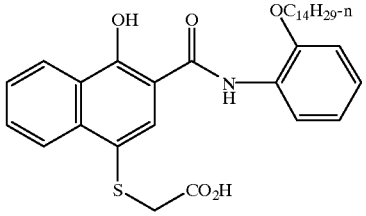

-continued
S-12
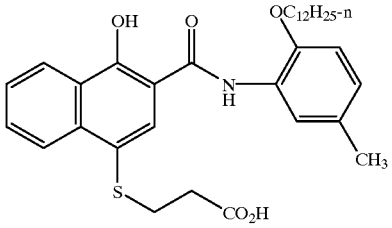
S-13
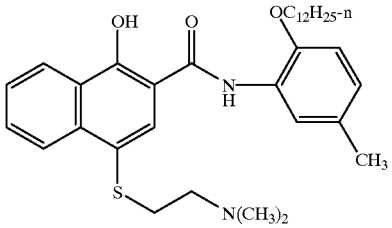
S-14
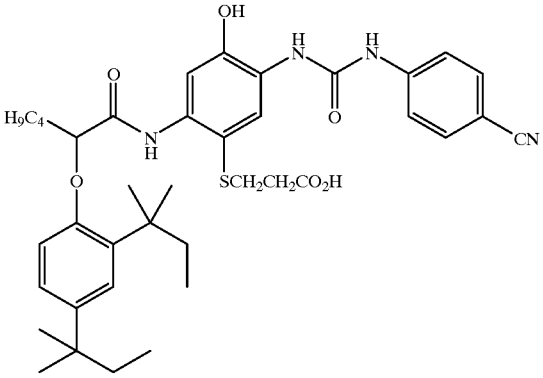
S-15
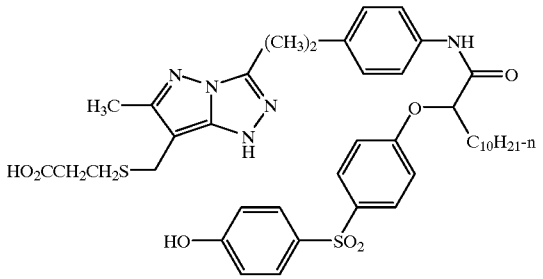
S-16
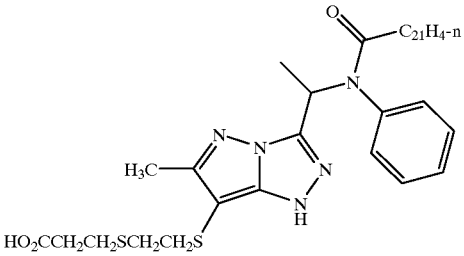
-continued
S-17
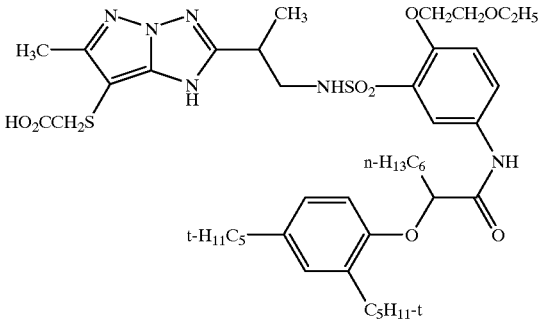
S-18
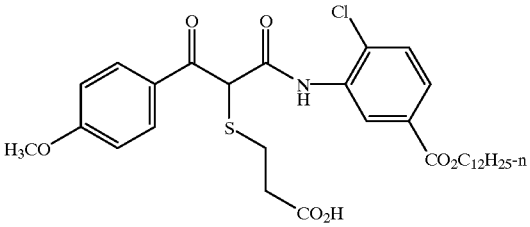
S-19
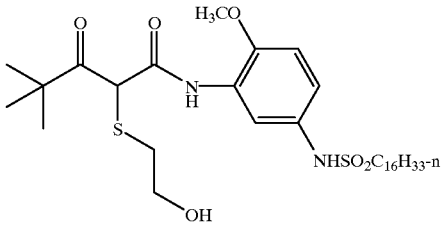
S-20
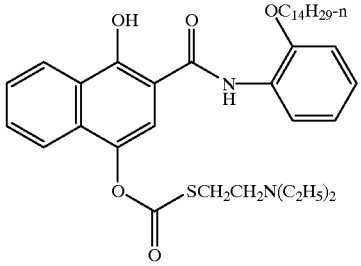
S-21
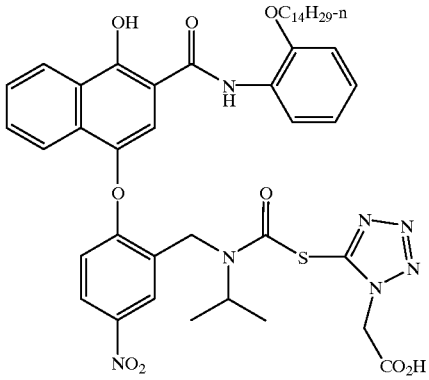

-continued

S-22

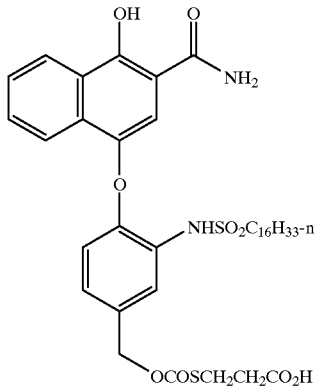

S-23

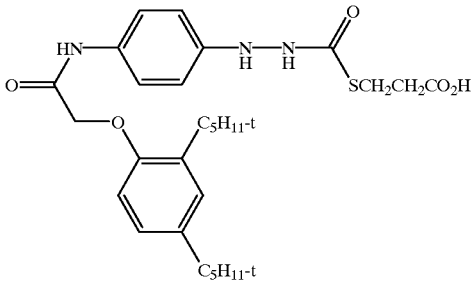

S-24

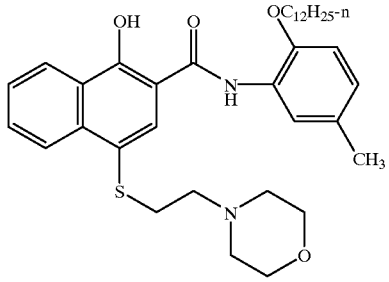

The amount of SMRC which can be employed with invention can be any concentration which is effective for the intended purpose. Good results have been obtained when the compound is employed at a concentration of from about 0.006 to about 0.50 mmoles/$m^2$, and more preferably at a concentration from about 0.02 to about 0.14 mmoles/$m^2$.

Unless otherwise specifically stated, substituent groups which may be substituted on molecules herein include any groups, whether substituted or unsubstituted, which do not destroy properties necessary for photographic utility. When the term "group" is applied to the identification of a substituent containing a substitutable hydrogen, it is intended to encompass not only the substituent's unsubstituted form, but also its form further substituted with any group or groups as herein mentioned. Suitably, the group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy) ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentyl-phenoxy)acetamido, alpha-(2,4-di-t-pentylphenoxy) butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecyl-phenylcarbonylamino, p-toluylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-toluylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-toluylsulfonamido, p-dodecylbenzenesulfonamido, N-methyltetradecylsulfonamido, N,N-dipropyl-sulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-toluylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-toluylsulfinyl; thio, such as ethylthio, octylthio, benzylthio, tetradecylthio, 2-(2,4 -di-t-pentylphenoxy) ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as I (N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. Generally, the above groups and substituents thereof may include those having up to 48 carbon atoms, typically 1 to 36 carbon atoms and usually less than 24 carbon atoms, but greater numbers are possible depending on the particular substituents selected.

The photographic elements of the invention can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. The photographic elements of this invention must contain at least two silver halide emulsion layers. The ETARCs and SMRCs utilized in this invention are contained in the same silver halide emulsion layer. However, the same or different ETARCs and SMRCs may also be used in additional layers of the photographic element. In one suitable embodiment the ETARCs and SMRCs are contained in the red-sensitive layer.

If desired, the photographic element can be used in conjunction with an applied magnetic layer as described in Research Disclosure, November 1992, Item 34390 published by Kenneth Mason Publications, Ltd., Dudley Annex, 12a North Street, Emsworth, Hampshire P010 7DQ, ENGLAND, the contents of which are incorporated herein by reference. Further, the photographic elements may have an annealed polyethylene naphthalate film base such as described in Hatsumei Kyoukai Koukai Gihou No. 94-6023, published Mar. 15, 1994 (Patent Office of Japan and Library of Congress of Japan) and may be utilized in a small format system, such as described in *Research Disclosure,* June 1994, Item 36230 published by Kenneth Mason Publications, Ltd., Dudley Annex, 12a North Street, Emsworth, Hampshire P010 7DQ, ENGLAND, and such as the Advanced Photo System, particularly the Kodak ADVANTIX films or cameras.

In the following Table, reference will be made to (1) *Research Disclosure,* December 1978, Item 17643, (2) *Research Disclosure,* December 1989, Item 308119, (3) *Research Disclosure,* September 1994, Item 36544, and (4) *Research Disclosure,* September 1996, Item 38957, all published by Kenneth 30 Mason Publications, Ltd., Dudley Annex, 12a North Street, Emsworth, Hampshire P010 7DQ, ENGLAND, the disclosures of which are incorporated herein by reference. The Table and the references cited in the Table are to be read as describing particular components suitable for use in the elements of the invention. The Table and its cited references also describe suitable ways of preparing, exposing, processing and manipulating the elements, and the images contained therein. Photographic elements and methods of processing such elements particularly suitable for use with this invention are described in *Research Disclosure,* February 1995, Item 37038, published by Kenneth Mason Publications, Ltd., Dudley Annex, 12a North Street, Emsworth, Hampshire P010 7DQ, ENGLAND, the disclosure of which is incorporated herein by reference.

| Reference | Section | Subject Matter |
|---|---|---|
| 1 | I, II | Grain composition, |
| 2 | I, II, IX, X, XI, XII, XIV, XV | morphology and preparation. Emulsion preparation including |
| 3 & 4 | I, II, III, IX A & B | hardeners, coating aids, addenda, etc. |
| 1 | III, IV | Chemical sensitization and |
| 2 | III, IV | spectral sensitization/ |
| 3 & 4 | IV, V | desensitization |
| 1 | V | UV dyes, optical |
| 2 | V | brighteners, luminescent |
| 3 & 4 | VI | dyes |
| 1 | VI | Antifoggants and |
| 2 | VI | stabilizers |
| 3 & 4 | VII | |
| 1 | VIII | Absorbing and scattering |
| 2 | VIII, XIII, XVI | materials; Antistatic layers; matting agents |
| 3 & 4 | VIII, IX C & D | |
| 1 | VII | Image-couplers and image- |
| 2 | VII | modifying couplers; Wash- |
| 3 & 4 | X | out couplers; Dye stabilizers and hue modifiers |
| 1 | XVII | Supports |
| 2 | XVII | |
| 3 & 4 | XV | |
| 3 & 4 | XI | Specific layer arrangements |
| 3 & 4 | XII, XIII | Negative working emulsions; Direct positive emulsions |
| 2 | XVIII | Exposure |
| 3 & 4 | XVI | |
| 1 | XIX, XX | Chemical processing; |
| 2 | XIX, XX, XXII | Developing agents |
| 3 & 4 | XVIII, XIX, XX | |
| 3 & 4 | XIV | Scanning and digital processing procedures |

The photographic elements can be incorporated into exposure structures intended for repeated use or exposure structures intended for limited use, variously referred to as single use cameras, lens with film, or photosensitive material package units.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, heteroxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in UK. Patents and published application Nos. 1,466,728, 1,531,927, 1,533,039, 2,006,755A and 2,017,704A, the disclosures of which are incorporated herein by reference.

Other image dye-forming couplers may be included in the element such as those image couplers already described above for CAR. In one preferred embodiment a dye forming coupler is contained in the same emulsion layer as the ETARC utilized in this invention. Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151,343, and 5,234,800.

It may be useful to use a combination of couplers any of which may contain known ballasts or coupling-off groups such as those described in U.S. Pat. No. 4,301,235; U.S. Pat. No. 4,853,319 and U.S. Pat. No. 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213.490; Japanese Published Application 58-172,647; U.S. Pat. Nos. 2,983,608; 4,070,191; and 4,273,861; German Applications DE 2,706,117 and DE 2,643,965; UK. Patent 1,530,272; and Japanese Application 58-113935. The masking couplers may be shifted or blocked, if desired.

The invention materials may be used in association with other nucleating agents, development accelerators or their precursors (UK Patent 2,097,140; UK. Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543,323.) Also, the compositions may be blocked or coated in protected form as described, for example, in Japanese Application 61/258,249 or U.S. Pat. No. 5,019,492.

The invention materials may further be used in combination with image-modifying compounds such as "Developer Inhibitor-Releasing" compounds (DIR's). DIR's useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering,* Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DLAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

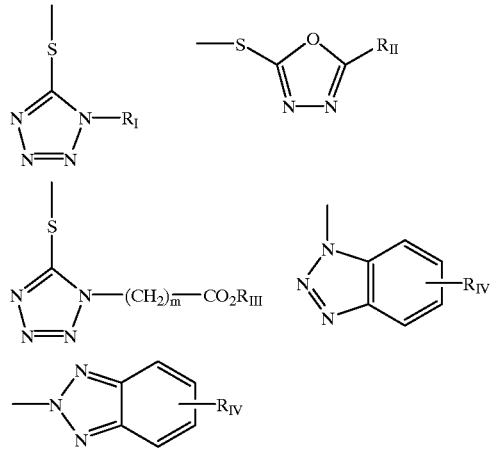

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

As mentioned, the developer inhibitor-releasing coupler may include a timing group, which produces the time-delayed release of the inhibitor group such as groups utilizing the cleavage reaction of a hemiacetal (U.S. Pat. No. 4,146,396, Japanese Applications 60-249148; 60-249149); groups using an intramolecular nucleophilic substitution reaction (U.S. Pat. No. 4,248,962); groups utilizing an electron transfer reaction along a conjugated system (U.S. Pat. Nos. 4,409,323; 4,421,845; Japanese Applications 57-188035; 58-98728; 58-209736; 58-209738) groups utilizing ester hydrolysis (German Patent Application (OLS) No. 2,626,315); groups utilizing the cleavage of imino ketals (U.S. Pat. No. 4,546,073); groups that function as a coupler or reducing agent after the coupler reaction (U.S. Pat. No. 4,438,193; U.S. Pat. No. 4,618,571) and groups that combine the features describe above. It is typical that the timing group or moiety is of one of the formulas:

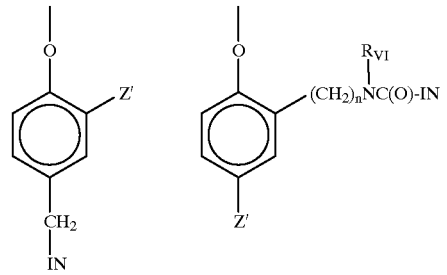

wherein IN is the inhibitor moiety, Z' is selected from the group consisting of nitro, cyano, alkylsulfonyl; sulfamoyl ($—SO_2NR_2$); and sulfonamido ($—NRSO_2R$) groups; n is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

Suitable developer inhibitor-releasing couplers for use in the present invention include, but are not limited to, the following:

D1

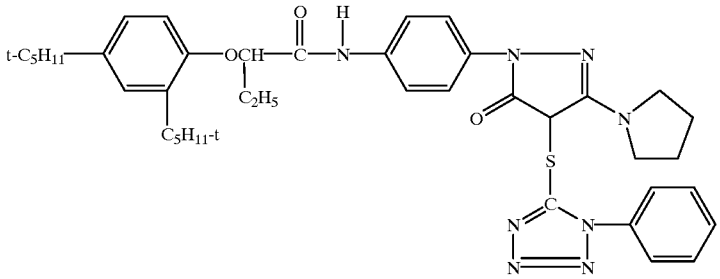

D2

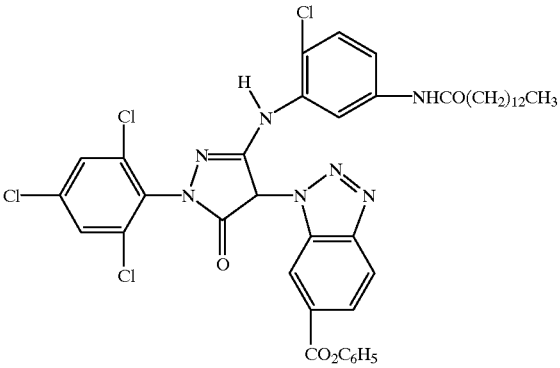

-continued
D3
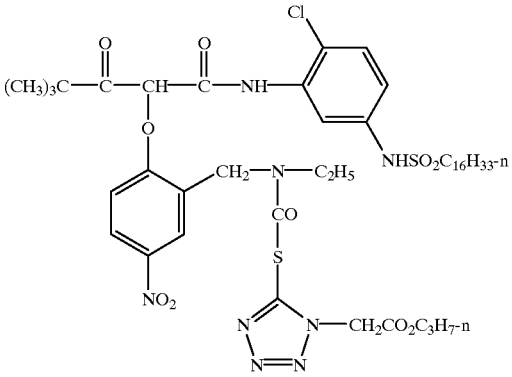
D4
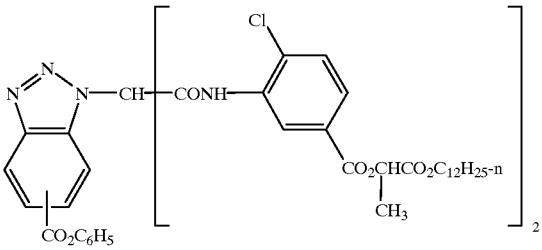
D5
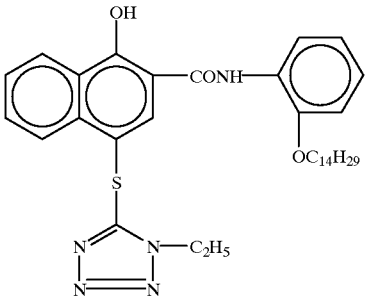
D6
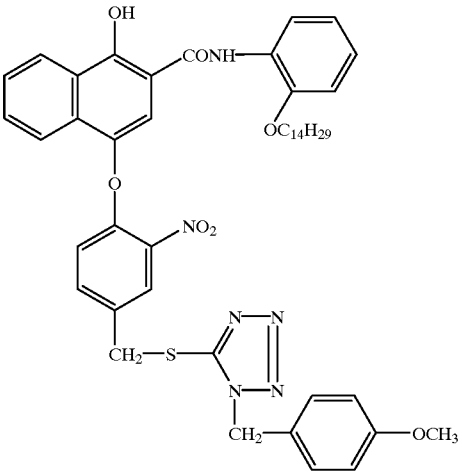
D7
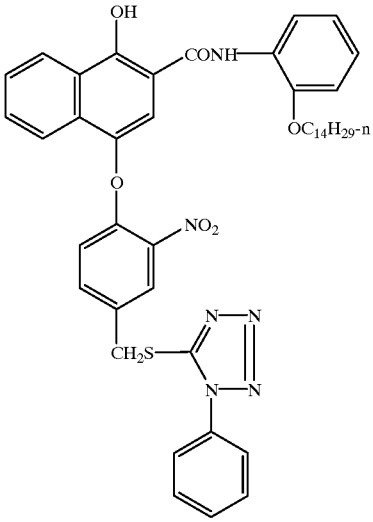
D8
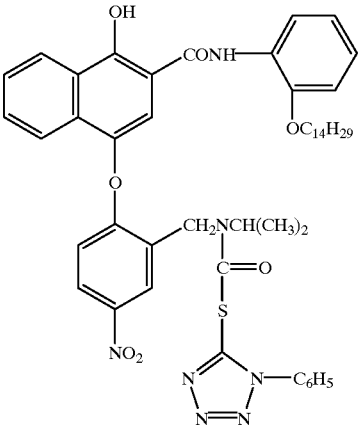

-continued

D9

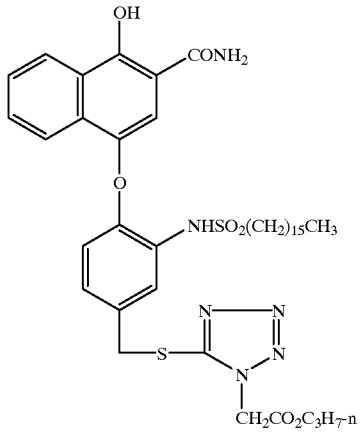

D10

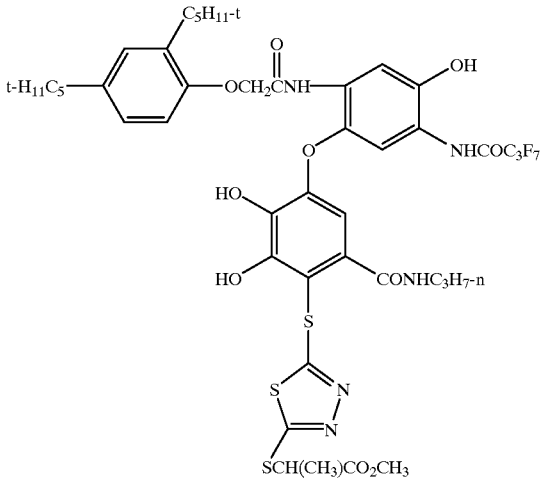

It is also contemplated that the concepts of the present invention may be employed to obtain reflection color prints as described in *Research Disclosure,* November 1979, Item 18716, available from Kenneth Mason Publications, Ltd, Dudley Annex, 12a North Street, Emsworth, Hampshire P0101 7DQ, England, incorporated herein by reference. Materials of the invention may be coated on pH adjusted support as described in U.S. Pat. No. 4,917,994; on a support with reduced oxygen permeability (EP 553,339); with epoxy solvents (EP 164,961); with nickel complex stabilizers (U.S. Pat. No. 4,346,165; U.S. Pat. No. 4,540,653 and U.S. Pat. No. 4,906,559 for example); with ballasted chelating agents such as those in U.S. Pat. No. 4,994,359 to reduce sensitivity to polyvalent cations such as calcium; and with stain reducing compounds such as described in U.S. Pat. No. 5,068,171. Other compounds useful in combination with the invention are disclosed in Japanese Published Applications described in Derwent Abstracts having accession numbers as follows: 90-072,629, 90-072,630; 90-072,631; 90-072,632; 90-072,633; 90-072,634; 90-077,822; 90-078,229; 90-078,230; 90-079,336; 90-079,337; 90-079,338; 90-079,690; 90-079,691; 90-080,487; 90-080,488; 90-080,489; 90-080,490; 90-080,491; 90-080,492; 90-080,494; 90-085,928; 90-086,669; 90-10 086,670; 90-087,360; 90-087,361; 90-087,362; 90-087,363; 90-087,364; 90-088,097; 90-093,662; 90-093,663; 90-093,664; 90-093,665; 90-093,666; 90-093,668; 90-094,055; 90-094,056; 90-103,409; 83-62,586; 83-09,959.

The silver halide emulsions utilized may be of any silver halide composition, including but not limited to silver bromide, silver bromoiodide, silver chloride, silver chlorobromide, and silver chloroiode. Preferably the silver halide emulsions utilized in this invention are bromoiodide emulsions.

The silver halide emulsions can contain grains of any size and morphology. Thus, the grains may take the form of cubes, octahedrons, cubo-octahedrons, or any of the other naturally occurring morphologies of cubic lattice type silver halide grains. Further, the grains may be irregular such as spherical grains or tabular grains.

Especially useful in this invention are tabular grain silver halide emulsions. Specifically contemplated tabular grain emulsions are those in which greater than 50 percent of the total projected area of the emulsion grains are accounted for by tabular grains having a thickness of less than 0.3 micron (0.5 micron for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in micrometers and t is the average thickness in micrometers of the tabular grains.

The average useful ECD of photographic emulsions can range up to about 10 micrometers, although in practice emulsion ECD's seldom exceed about 4 micrometers. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin ($t<0.2$ micrometer) tabular grains. To achieve the lowest levels of granularity it is preferred that aim tabular grain projected areas be satisfied with ultrathin ($t<0.06$ micrometer) tabular grains. Tabular grain thicknesses typically range down to about 0.02 micrometer. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micrometer. Ultrathin tabular grain high chloride emulsions are disclosed by Maskasky U.S. Pat. No. 5,217,858.

As noted above tabular grains of less than the specified thickness account for at least 50 percent of the total grain projected area of the emulsion.

To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

Suitable tabular grain emulsions can be selected from among a variety of conventional teachings, such as those of the following: Research Disclosure, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. The described elements can be processed in the known Kodak C-41 color process as described in The British Journal of Photography Annual of 1988, pages 191–198 or in other known color negative film processes. Where applicable, the element may be processed in accordance with color print processes such as the RA-4 process of Eastman Kodak Company as described in the British Journal of Photography Annual of 1988, Pp 198–199. The element may also be processed in a motion imaging color negative format/process such as Kodak ECN-2 Process, a complete description of which is contained in the Kodak H-24 Manual (Manual for Processing Eastman Motion Picture Films; H-24 Manual; Eastman Kodak Company, Rochester, N.Y.) Such negative working emulsions are typically sold with instructions to process using a color negative method such as the mentioned C-41 or RA-4 process. To provide a positive (or reversal) image, the color development step can be preceded by development with a non-chromogenic developing agent to develop exposed silver halide, but not form dye, and followed by uniformly fogging the element to render unexposed silver halide developable. Such reversal emulsions are typically sold with instructions to process using a color reversal process such as E-6. Alternatively, a direct positive emulsion can be employed to obtain a positive image.

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(2-methanesulfonamidoethyl)aniline sesquisulfate hydrate, 4-amino-3-methyl-N-ethyl-N-(2-hydroxyethyl)aniline sulfate, 4-amino-3-(2-methanesulfonamido-ethyl)-N,N-diethylaniline hydrochloride and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

The following examples are intended to illustrate, but not to limit the invention.

SYNTHETIC EXAMPLES

Electron transfer agent releasing coupler compounds of this invention can be prepared by several synthetic routes. Many of the preferred ETAs of this patent are esters of 4-(hydroxymethyl)-4-methyl-1-phenyl-3-pyrazolidinone. Selective formation of esters at the 4-hydroxymethyl group of 4-(hydroxymethyl)-4-methyl-1-phenyl-3-pyrazolidinone has been reported in U.K. Patent 2,073,734 and can be accomplished by treating 4-(hydroxymethyl)-4-methyl-1-phenyl-3-pyrazolidinone with an acid chloride in refluxing toluene. The resulting ETA can be converted, by treatment with phosgene, to the corresponding carbamoyl chloride that is then caused to react with an amino group or linking group attached to a coupler. The following synthesis of ETARC Compound E-2, as shown above, is prepared by this procedure.

Synthesis No. 1

Preparation of electron transfer agent releasing Compound E-2:

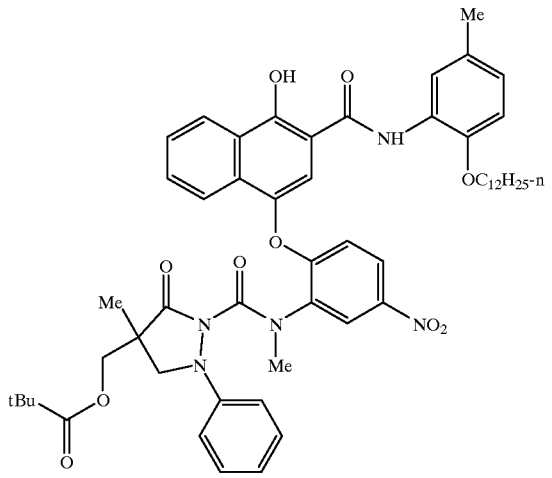

A schematic representation of the reactions involved in this synthesis is as follows:

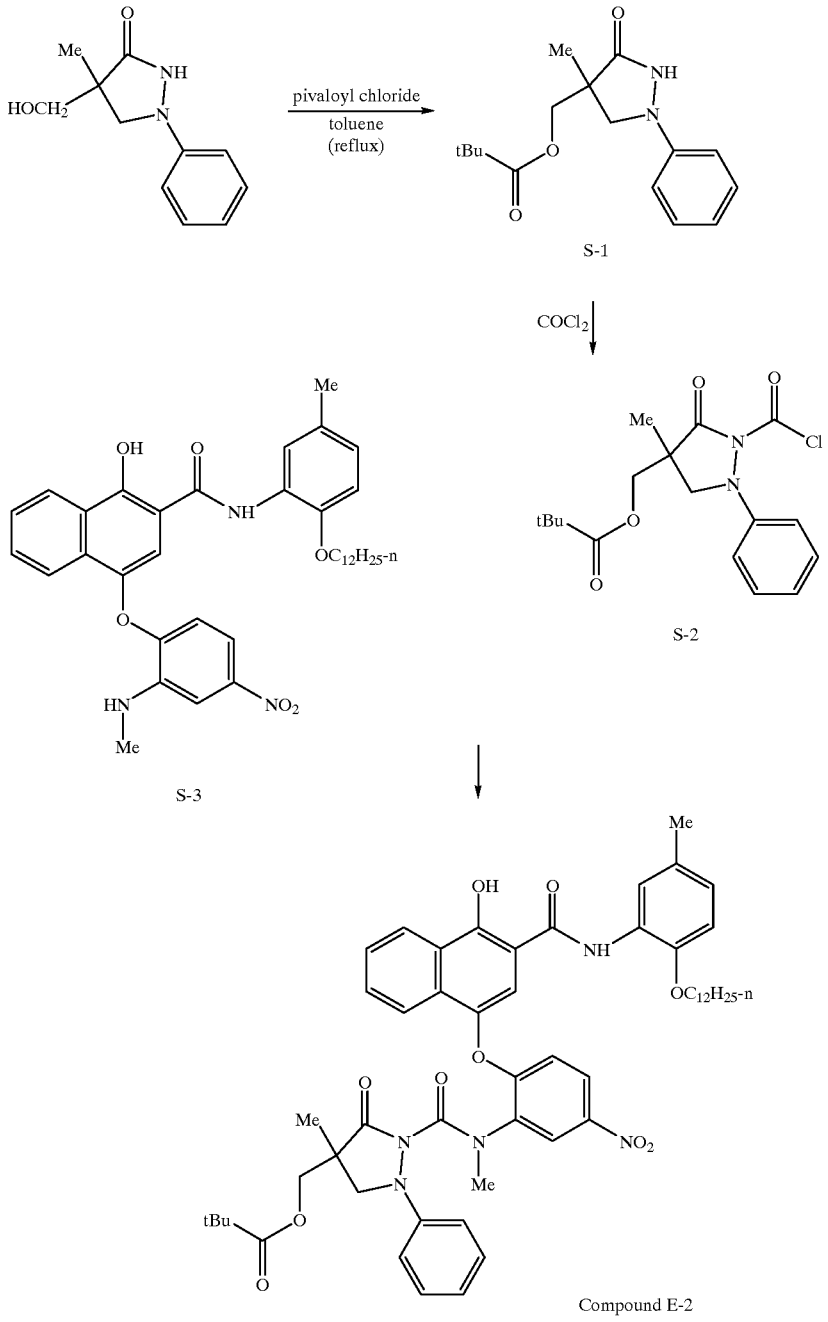

Synthesis of Intermediate S-1

A 1 L 3-neck reaction flask was charged with 4-(hydroxymethyl)-4-methyl-1-phenyl-3-pyrazolidinone (Aldrich, 90%, remainder isopropanol, 20 g, 87 mmol). Toluene (220 mL) was added and the solution was warmed almost to reflux. Pivaloyl chloride (15 mL, 122 mmol) was added dropwise as a solution in toluene (20 mL). The solution was heated to reflux for 2 h. The solution was cooled to 40° C. and the toluene was removed at reduced pressure. The resulting oil was diluted with EtOAc. The organic phase was washed with water, brine and dried over $MgSO_4$. After removing the solvents, the oil was allowed to sit at reduced pressure (~1 mm Hg) for ~30 min. Absolute ethanol (50 mL) was added and then most of the ethanol was removed to give a thick oil containing a small amount of EtOH. This was allowed to sit at 25° C. overnight whereupon crystals formed. The solid was filtered and washed once with EtOH and three times with P950 ligroin. After drying, intermediate S-1 (20.3 g, 80%) was obtained as a white solid.

Synthesis of Intermediate S-2

A 2 L 3-neck flask equipped with an overhead stirrer and 500 mL addition funnel was flushed with dry nitrogen.

Phosgene (1.93M in toluene, 235 mL, 451 mmol) was added followed by 600 mL $CH_2Cl_2$. The solution was cooled to −70° C. Intermediate S-1 (119 g, 410 mmol) was dissolved in $CH_2Cl_2$ (500 mL) in a 1 L Erlenmeyer flask. Diisopropylethylamine (79.0 mL, 451 mmol) was added to the solution of intermediate S-1 to form a red solution. The red solution was added to the −70° C. phosgene solution over 45 min. via the addition funnel. The reaction was maintained at −70° C. for 2 h. Concentrated HCl (10 mL) was added and the cold reaction mixture diluted with $CH_2Cl_2$ (500 mL). The cold organic layer was placed in a 2 L separatory funnel and washed with 10% HCl (2×200 mL) and brine (1×200 mL). The organic extract was dried over $MgSO_4$. After removing the $CH_2Cl_2$, the yellow oil was transferred to a 500 mL Erlenmeyer flask, rinsing with the minimum amount of warm toluene (3×15 mL). Ligroin P950 (100 mL) was added and the solution was allowed to sit at 25° C. as a white solid started to form. The flask was covered and stored at 4° C. overnight. The solids were filtered and placed under reduced pressure to give 150 g (~100%) of intermediate S-2 containing a small amount of toluene.

Synthesis of Compound E-2

A 2 L 3-neck flask was equipped with an overhead stirrer, a nitrogen inlet and was charged with intermediate S-3 (87 g, 138 mmol). THF (700 mL) was added followed by dimethylaniline (87 mL, 690 mmol) and the mixture was cooled to 0° C. Intermediate S-2 (59.0 g, 166 mmol) was added in one portion and the reaction was allowed to slowly warm to 25° C. After 17 h, the reaction was poured into 200 g ice plus 200 mL 3N HCl. The organic layer was extracted into EtOAc (3×200 mL), washed with 5% HCl, and brine. After drying over $MgSO_4$, the solvents were removed to give an orange foam. The crude foam was crystallized from hot n-heptane using 8 mL n-heptane per gram of crude product. After filtering and washing the resulting solid with hexanes, compound E-2 (117 g, 90%) was obtained as a cream colored solid.

Synthesis No. 2

Preparation of electron transfer agent releasing Compound E-5:

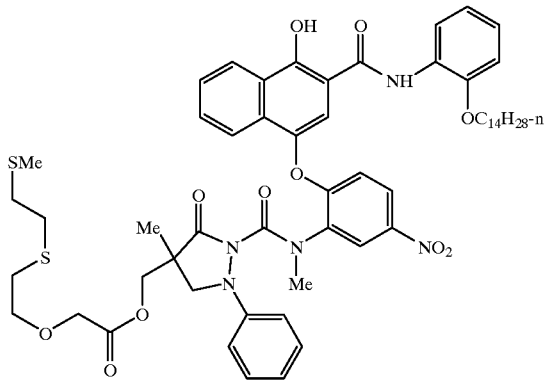

A schematic representation of the reactions involved in this synthesis is as follows:

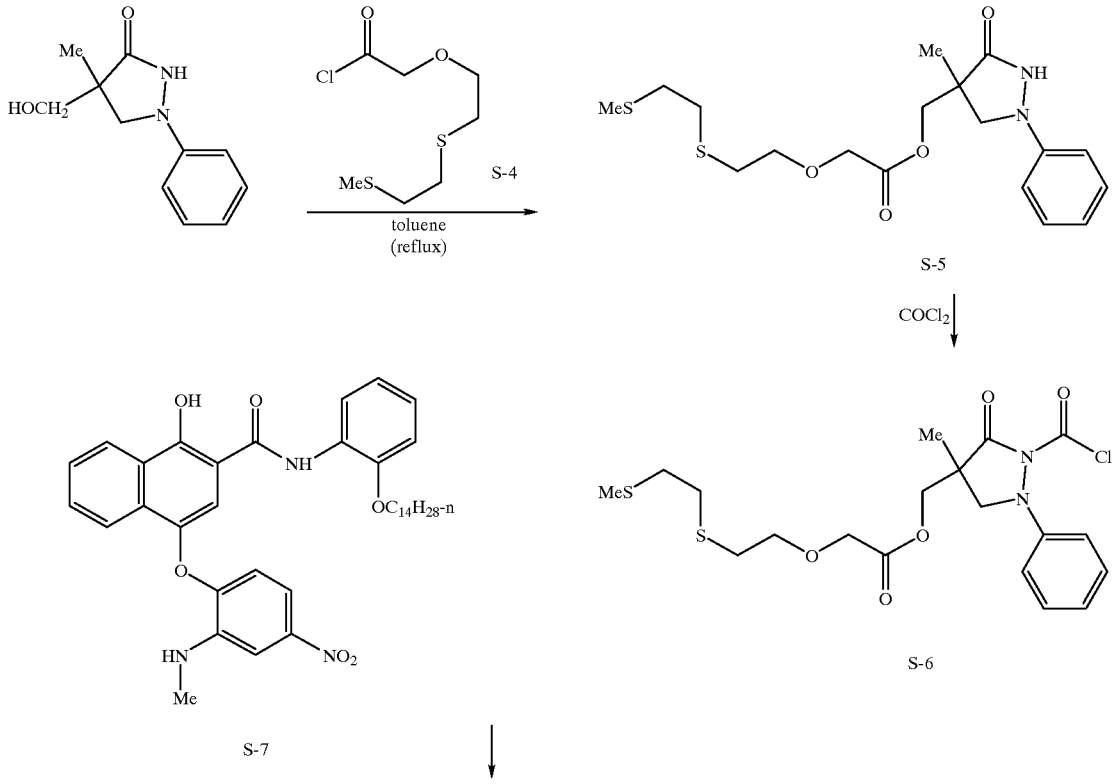

-continued

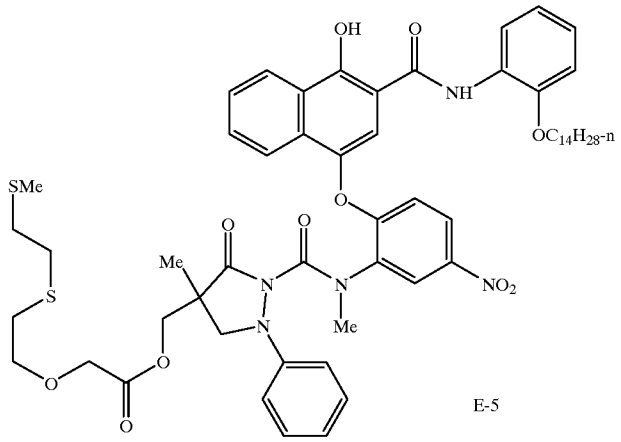

Synthesis of Intermediate S-5

A 500 mL reaction flask was charged with 4-(hydroxymethyl)-4-methyl-1-phenyl-3-pyrazolidinone (9.8 g, 47 mmol). Toluene (200 mL) was added and the solution was warmed almost to reflux. Intermediate S-4 (47 mmol) was added dropwise as a solution in toluene (20 mL). The solution was heated to reflux for 1 h. The reaction was cooled to 40° C. and the toluene was removed at reduced pressure. The resulting oil was diluted with EtOAc. The organic phase was washed with water, brine and dried over $MgSO_4$. After removing the solvents, the oil was purified by silica gel chromatography eluting with a 1:1 mixture of EtOAc and ligroin. Intermediate S-S (5.6 g, 30%) was obtained as a yellow oil.

Synthesis of Intermediate S-6

A 250 mL flask was flushed with dry nitrogen. Phosgene (1.93M in toluene, 8.6 mL, 16.6 mmol) was added followed by 25 mL of $CH_2Cl_2$. The solution was cooled to −70° C. Intermediate S-5 (6.0 g, 15 mmol) was dissolved in $CH_2Cl_2$ (25 mL) in a 125 mL Erlenmeyer flask. Diisopropylethylamine (2.9 mL, 17 mmol) was added to the solution of S-5 to form a red solution. This red solution was added to the −70° C. phosgene solution over 15 min. via an addition funnel. The reaction was maintained at −70° C. for 0.5 h. Concentrated HCl (1 mL) was added and the cold reaction mixture diluted with $CH_2Cl_2$ (100 mL). The cold organic layer was placed in a separatory funnel and washed with 10% HCl (2×20 mL) and brine (1×20 mL). The organic extract was dried over $MgSO_4$. The solvents were removed under reduced pressure to give intermediate S-6 as a yellow oil.

Synthesis of Compound E-5

A 250 mL flask was equipped with a nitrogen inlet and was charged with intermediate S-7 (7.5 g, 11 mmol). Tetrahydrofuran (THF) (60 mL) was added followed by dimethylaniline (7.4 mL, 58 mmol) and the mixture was cooled to 0° C. Intermediate S-6 (15 mmol) was added as a solution in THF (10 mL) and the reaction was allowed to slowly warm to 25° C. After 17 h, the reaction was poured into ice and 3N HCl (10 mL). The aqueous layer was extracted with EtOAc (3×50 mL), washed with 5% HCl, and brine. After drying over $MgSO_4$, the solvents were removed to give an orange foam. The crude foam was purified by silica gel chromatography to give compound E-5 (8.5 g, 69%) as a foam.

Synthesis No. 3

Preparation of electron transfer agent releasing Compound E-11:

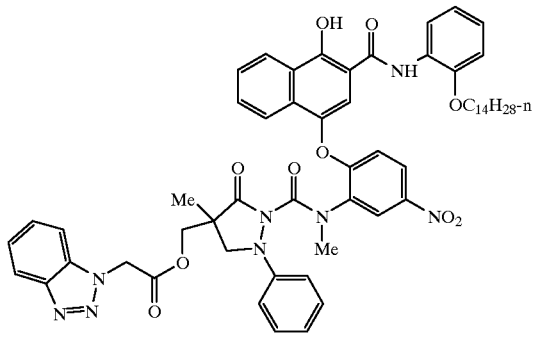

A schematic representation of the reactions involved in this synthesis is as follows:

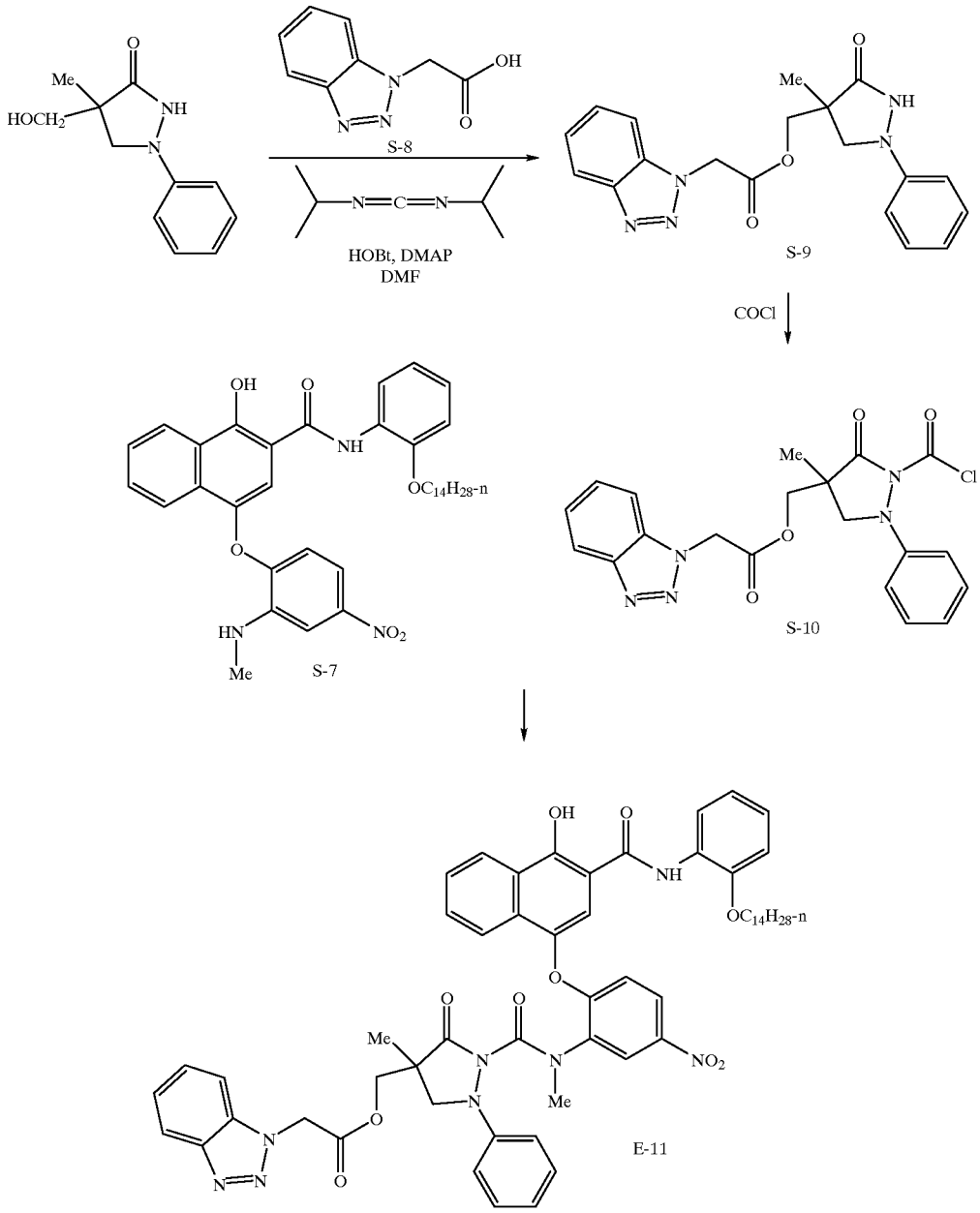

Synthesis of Intermediate S-9

A 500 mL reaction flask was charged with 4-(hydroxymethyl)-4-methyl-1-phenyl-3-pyrazolidinone (15.4 g, 74.8 mmol), intermediate S-8 (12.0 g, 68.0 mmol), hydroxybenzotriazole (9.2 g, 68 mmol), 4-dimethylaminopyridine (1.7 g, 13 mmol) and DMF (220 mL). The solution was cooled to 0° C. and 1,3-diisopropylcarbodiimide (14 mL, 88 mmol) was added dropwise and the reaction was allowed to stir for 1 h at 0° C. The ice bath was removed and the reaction was warmed to 25° C. and stirred for 1.5 h. The reaction mixture was poured into cold 5% HCl and the aqueous layer was extracted with EtOAc (3×100 mL). The combined organic extracts were washed with water, brine and dried over $MgSO_4$. After removing the solvents, the product was purified by silica gel chromatography and the resulting solid was washed with a 9: 1 mixture of $Et_2O$: $CH_3CN$ to remove the remaining diisopropylurea byproduct. Intermediate S-9 (9.3 g, 38%) was obtained as a white solid.

Synthesis of Intermediate S-10

A 250 mL flask was flushed with dry nitrogen. Phosgene (1.93M in toluene, 4.7 mL, 9.0 mmol) was added followed by 40 mL $CH_2Cl_2$. The solution was cooled to −70° C. Intermediate S-9 (3.0 g, 8.2 mmol) was dissolved in THF (20 mL) in a 125 mL Erlenmeyer flask. Diisopropylethylamine (1.6 mL, 9.0 mmol) was added to the solution of S-9. This solution was added to the −70° C. phosgene solution over 15 min. via an addition funnel. The reaction was maintained at −70 C for 1.5 h. The solvents were removed under reduced pressure and the mixture diluted with cold $CH_2Cl_2$ (600 mL). The cold organic layer was placed in a separatory funnel and washed with 2N HCl (2×40 mL) and brine (1×40 mL). The organic extract was dried over $MgSO_4$. The solvents were removed under reduced pressure to give 3.5 g of intermediate S-10 as an orange solid.

Synthesis of Compound E-11

A 250 mL flask was equipped with a nitrogen inlet and was charged with intermediate S-7 (4.0 g, 5.9 mmol). THF (60 mL) was added followed by dimethylaniline (3.7 mL, 29 mmol) and the mixture was cooled to 0° C. Intermediate S-10 (8.8 mmol) was added in one portion and the reaction was allowed to slowly warm to 25° C. After 17 h, the reaction was poured into ice and 3N HCl (20 mL). The aqueous layer was extracted with EtOAc (2×100 mL), washed with 5% HCl, and brine. After drying over $MgSO_4$, the solvents were removed to give an orange foam. The crude foam was purified by silica gel chromatography to give compound E-11 (3.1 g, 51%) as a foam.

EXAMPLE 1

Photographic Multilayer Examples

Multilayer films with format ML-A demonstrating the principles of this invention were produced by coating the following layers on a cellulose triacetate support. Structures of components are shown elsewhere in this text. Component laydowns are provided in units of gm/sq m. Emulsion sizes as determined by the disc centrifuge method are reported in microns (Diameter x Thickness). (Bislvinylsulfonyl) methane hardener was used at 1.55% of total gelatin weight. Antifoggants (including 4-hydroxy-6-methyl-1,3,3a,7-tetraazaindene), surfactants, coating aids, coupler solvents, emulsion addenda, sequestrants, lubricants, matte and tinting or speed attenuating dyes were added to the appropriate layers as is common in the art.

ML-A-1

Layer 1 (Protective Overcoat Layer): gelatin at 0.888.

Layer 2 (UV Filter Layer): silver bromide Lippman emulsion at 0.215, UV-1 and UV-2 both at 0.108 and gelatin at 0.699.

Layer 3 (Fast Yellow Layer): a blend of two blue sensitized (all with BSD-1) silver iodobromide emulsions (i) a large 3d grain emulsion (1.4 μm, 14 mole % I) at 0.936, (ii) a large sized tabular grain emulsion ( 2.9×0.13 μm, 4.5 mole % I) at 0.387, YC-1 at 0.445, IR-1 at 0.027, B-1 at 0.011 and gelatin at 1.70.

Layer 4 (Slow Yellow Layer): a blend of three blue sensitized (all with BSD-1) tabular silver iodobromide emulsions (i) 0.96×0.26 μm, 6 mole % I at 0.20 (ii) 1.0×0.13 μm, 1.5 mole % I at 0.081 (iii)) 0.54×0.08 μm, 1.3 mole % I at 0.366, yellow dye forming coupler YC-1 at 0.732, IR-1 at 0.027, B-1 at 0.003 and gelatin at 1.61.

Layer 5 (Yellow filter layer): YFD-1 at 0.108, O×DS-1 at 0.075 and gelatin at 0.538.

Layer 6 (Fast Magenta Layer): a green sensitized (with a mixture of GSD-1 and GSD-2) silver iodobromide tabular emulsions (4.1×0.14 μm, 4.5 mole % iodide) at 1.29, magenta dye forming coupler MC-1 at 0.074, IR-2 at 0.004 and gelatin at 1.78.

Layer 7 (Mid Magenta Layer): a green sensitized (with a mixture of GSD-1 and GSD-2) silver iodobromide tabular emulsions: (i) 2.9×0.12 μm, 3.7 mole % iodide at 0.968, magenta dye forming coupler MC-1 at 0.048, Masking Coupler MM-1 at 0.108, IR-2 at 0.011 and gelatin at 1.56.

Layer 8 (Slow magenta layer): a blend of two green sensitized (both with a mixture of GSD-1 and GSD-2) silver iodobromide tabular emulsions: (i) 1.2×0.12 μm, 4.5 mole % iodide at 0.355 and (ii) 0.88×0.12 μm, 2.6 mole % iodide at 0.527, magenta dye forming coupler MC-1 at 0.266, Masking Coupler MM-1 at 0.075 and gelatin at 1.18.

Layer 9 (Interlayer): O×DS-1at 0.075 and gelatin at 0538.

Layer 10 (Fast Cyan layer): a red-sensitized (with a mixture of RSD-1 and RSD-2) iodobromide tabular emulsion (4.0×0.13 μm, 4.0 mole % I) at 0.129, cyan dye-forming coupler CC-2 at 0.20, IR-3 at 0.022, IR-4 at 0.025, O×DS-1 at 0.014 and gelatin at 1.29.

Layer 11 (Mid Cyan Layer): a red-sensitized (all with a mixture of RSD-1 and RSD-2) iodobromide tabular emulsion (2.2×0.12 μm, 3.0 mole % I) at 1.17, cyan dye-forming coupler CC-2 at 0.181, IR-3 at 0.011, IR-4 at 0.011, masking coupler CM-1 at 0.032, O×DS-1 at 0.011 and gelatin at 1.61.

Layer 12 (Slow cyan layer): a blend of two red sensitized (all with a mixture of RSD-1 and RSD-2) silver iodobromide emulsions: (i) a large sized iodobromide tabular grain emulsion (1.2×0.12 μm, 4.1 mole % I) at 0.258, (ii) a smaller iodobromide tabular emulsion (0.74×0.12 μm), 4.1 mole % I) at 0.305, cyan dye-forming coupler CC-1 at 0.249, CC-2 at 0.363, masking coupler CM-1 at 0.032, soluble mercaptan releasing coupler B-1 at 0.081 and gelatin at 1.99.

Layer 13 (Interlayer): O×DS-1 at 0.086 and gelatin at 0538.

Layer 14 (Antihalation layer): Black Colloidal Silver at 0.151, UV-1 and UV-2 both at 0.075 and gelatin at 1.61.

Support: cellulose triacetate

ML-A-2 is like ML-A-1 with the following change:

Layer 10 (Fast Cyan layer): a red-sensitized (with a mixture of RSD-1 and RSD-2) iodobromide tabular emulsion (4.0×0.13 μm, 4.0 mole % I) at 0.129, cyan dye-forming coupler CC-2 at 0.172, soluable mercaptan releasing coupler B-I at 0.022, IR-3 at 0.022, IR-4 at 0.025, O×DS-1 at 0.014 and gelatin at 1.29.

ML-A-3 is like ML-A-1 with the following change;

Layer 10 (Fast Cyan layer): a red-sensitized (with a mixture of RSD-1 and RSD-2) iodobromide tabular emulsion (4.0×0.13 μm, 4.0 mole % I) at 0.129, cyan dye-forming coupler CC-1 at 0.075, Electron Transfer Releasing Coupler E-2 at 0.086, IR-3 at 0.022, IR-4 at 0.025, O×DS-1 at 0.014 and gelatin at 1.29.

ML-A-4 is like ML-A-1 with the following change:

Layer 10 (Fast Cyan layer): a red-sensitized (with a mixture of RSD-1 and RSD-2) iodobromide tabular emulsion (4.0×0.13 μm, 4.0 mole % I) at 0.129, cyan dye-forming coupler CC-1 at 0.075, Electron Transfer Releasing Coupler E-2 at 0.086, soluble mercaptan releasing coupler B-1 at 0.022, IR-3 at 0.022, IR-4 at 0.025, O×DS-1 at 0.014 and gelatin at 1.29.

ML-A-5 is like ML-A-1 with the following change:

Layer 10 (Fast Cyan layer): a red-sensitized (with a mixture of RSD-1 and RSD-2) iodobromide tabular emulsion (4.0×0.13 μm, 4.0 mole % I) at 0.129, cyan dye-forming coupler CC-1 at 0.075, Electron Transfer Releasing Coupler C-3 at 0.086, soluble mercaptan releasing coupler B-1 at 0.022, IR-3 at 0.022, IR-4 at 0.025, O×DS-1 at 0.014 and gelatin at 1.29.

Results from testing of multilayers ML-A-1 to 5 are shown below (Table 1) and employ the following definitions.

Processing and Measurements

ΔGreen or Red Speed: Samples of each element were given a neutral 5500K stepped exposure and developed in a C-41 process described in *British Journal of Photography* 1982 *Annual,* pp 209 (which includes development using a p-phenylenediamine type compound) the description of which is incorporated herein by reference. Speed or light sensitivity toward red or green light relative to a check position (e.g. ML-A-1) were determined by comparing the exposure at a point 0. 15 density units above fog.

noticeable improvement in graininess as described by D. Zwick and D. Brothers, (*J. Soc. Mot. Pict. Telev. Eng.,* v86, p427–430, 1977).

ΔDensity (Gsep-Gneut) : A green separation was obtained by a 5500K+WRATTEN 99 filter with stepped exposure and developed in a process described in *British Journal of Photography* 1982 *Annual,* pp 209 (which includes development using a p-phenylenediamine type compound) the description of which is incorporated herein by reference. Speed or light sensitivity towards green light of a green separation exposure as determined at an exposure 0.15 density units above fog. The differences in density between the green of a neutral exposure (as defined above) and a green separation exposure measure at 1.5 logE from a speed point are recorded in Table 1. Δ*Density* (*Gsep-Gneut*) is a measure of how the green record is influenced by development in other records. Lower relative values indicate undesirable wrong way interimage effects.

TABLE 1

| | | Multilayer ML-A Results | | | | |
|---|---|---|---|---|---|---|
| Example | Layer 10 Variations | ΔGreen Speed (logE) | ΔRed Speed (logE) | ΔRMS Red Gran. | Δ% RMS Red Gran. | ΔDensity (Gsep-Gneut) |
| ML-A-1 | No ETARC, No SMRC | check | check | 14.4 | Check | 0.37 |
| ML-A-2 | B-1 (SMRC) | −0.02 | −0.01 | 12.7 | −12% | 0.35 |
| ML-A-3 | E-2 (ETARC ClogP = 2.9) | −0.01 | 0.05 | 13.8 | −4% | 0.31 |
| ML-A-4 | B-1 (SMRC) and E-2 (ETARC ClogP = 2.9) (Invention) | −0.02 | 0.05 | 11.1 | −23% | 0.30 |
| ML-A-5 | B-1 (SMRC) and C-3 (ETARC ClogP = 0.81) | +0.06 | 0.12 | 10.9 | −24% | 0.18 |

ΔRMS Red Granularity: The visual sensation of nonuniformity in a developed photographic film, noise, is termed graininess, whereas an objective measure of noise is called granularity. Granularity of a red layer of a neutral exposure was determined by the RMS method (see *The Theory of Photographic Process,* $4^{th}$ Edition, T. H. James, pp. 618–628) using a 48 micron aperture at a density 0.6 logE exposure units from a speed point 0.15 density units above the fog level. RMS values are a measure of the standard deviation of density at various densities. Lower RMS granularity values indicate improved photographic performance.

Δ% RMS Red Granularity: The % change in RMS Red granularity of neutral exposures were compared relative to the check (ML-A-1). Negative *% RMS Red Granularity* values indicate a desirable improvement in photographic performance. A 6% change in RMS Granularity offers a The results in Table 1 from multilayer format ML-A show that ETARCs increase the photographic sensitivity (speed) of the red of a neutral exposure. While both ETARCs and SMRCs individually lower granularity, the combination of an ETARC with a soluble mercaptan releasing coupler (SMRC) offers a synergy that gives a surprisingly larger reduction in Red RMS granularity. However, only the invention, the unique combination of a SMRC plus an ETARC that releases a blasted ETA with a ClogP equal to or greater than 2.4, offers the desired combination of improved photographic performance without the deleterious effects of wrong way interimage. (i.e. increased speed and improved granularity but without significant wrong way interimage effects). Similar findings result when such films are processed in a motion imaging color negative format/process such as Kodak ECN-2 Process, a complete description of which is contained in the Kodak H-24 Manual (Manual for Processing Eastman Motion Picture Films; H-24 Manual; Eastman Kodak Company, Rochester, N.Y.)

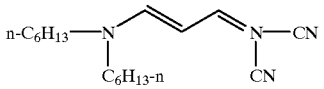
UV-1
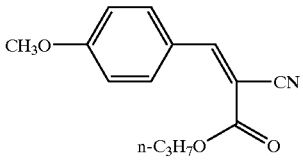
UV-2
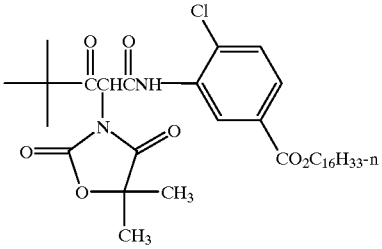
YC-1
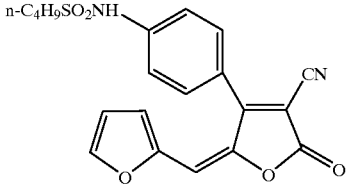
YFD-1
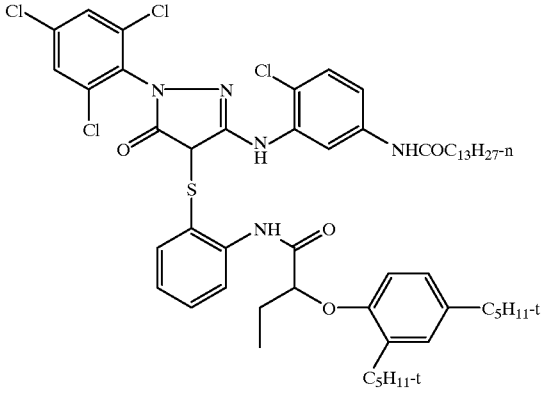
MC-1
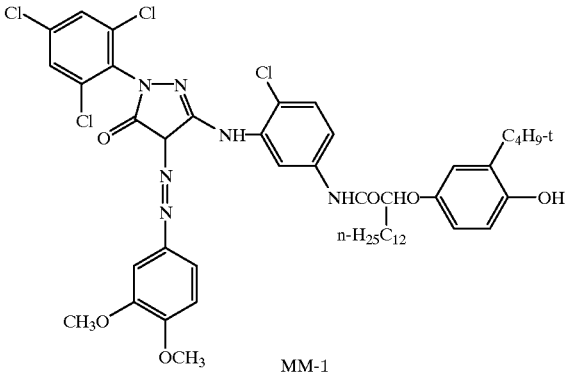
MM-1
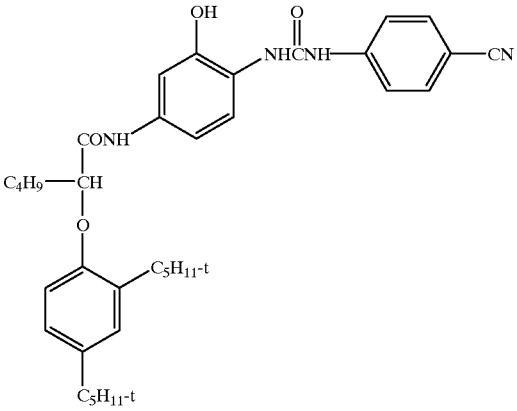
CC-1
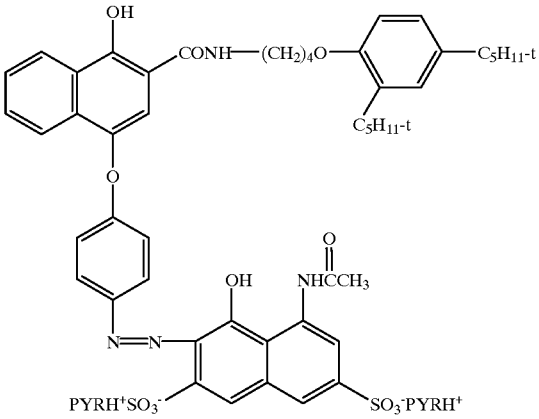
CM-1

-continued
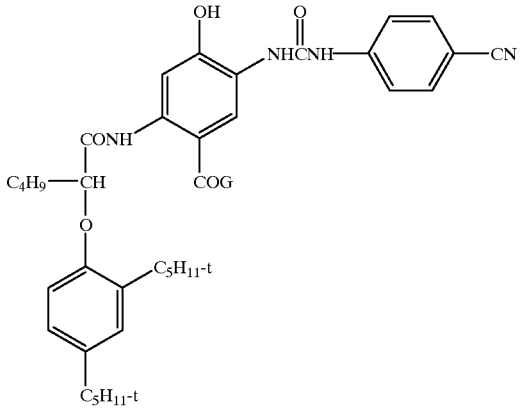
CC-2
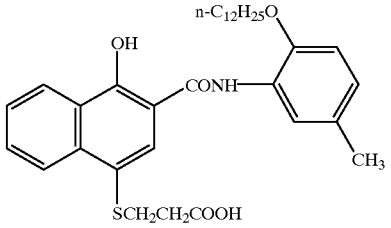
B-1
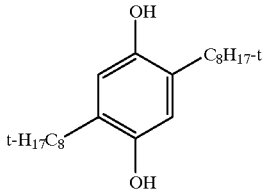
OxDS-1
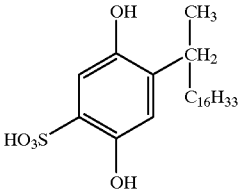
OxDS-2
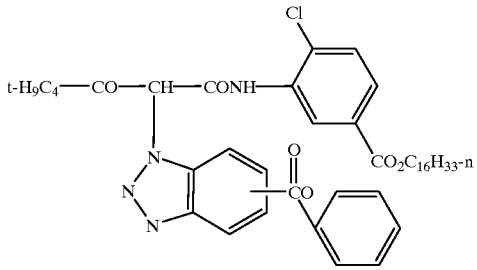
IR-1
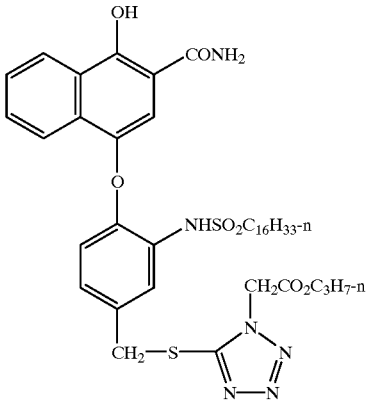
IR-2
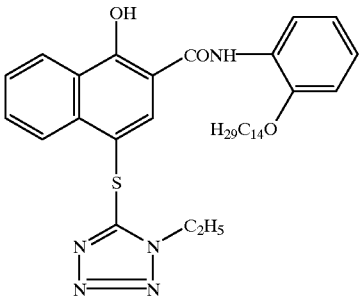
IR-3
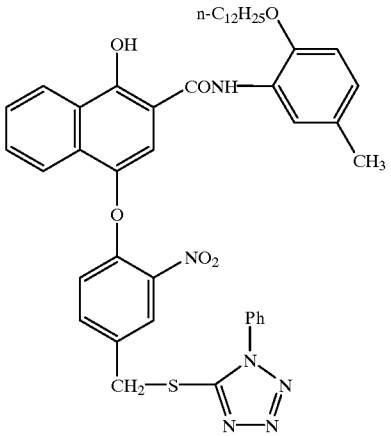
IR-4

-continued

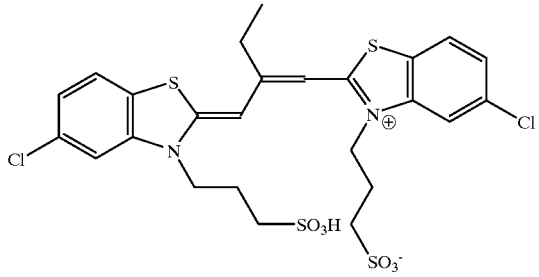

RSD-1

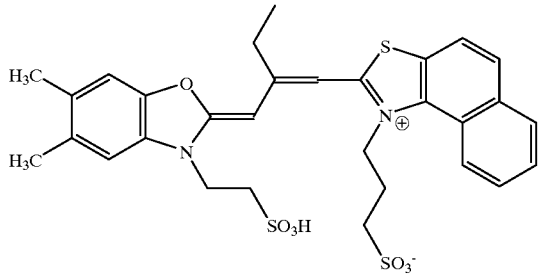

RSD-2

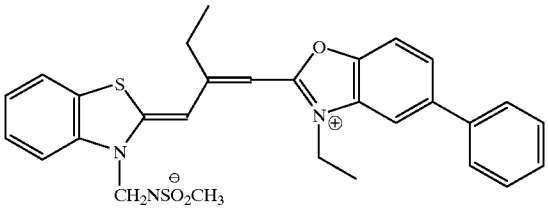

GSD-1

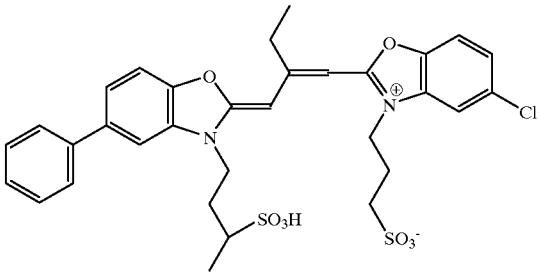

GSD-2

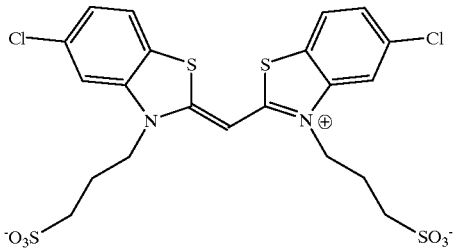

BSD-1

The invention has been described in detail with particular reference to certain preferred embodiments thereof, but it will be understood that variations and modifications can be effected within the spirit and scope of the invention.

What is claimed is:

1. A photographic element comprising a support and at least two silver halide emulsion layers wherein at least one emulsion layer contains an electron transfer agent releasing compound represented by the formula:

$$CAR—(L)_n—ETA$$

wherein:

CAR is a carrier moiety which is capable of releasing $—(L)_n—ETA$ on reaction with oxidized developing agent;

L is a divalent linking group, n is 0, 1 or 2 and L is not an —O—CO— group; and

ETA is a releasable l-aryl-3-pyrazolidinone electron transfer agent having a calculated log partition coefficient (c log P) greater than or equal to 2.40 bonded to L or CAR through either the nitrogen atom in the 2-position or the oxygen attached to the 3-position of the pyrazolidinone ring; and at least one soluble mercaptan releasing compound.

2. The photographic element of claim 1 wherein n is 1 or 2 and CAR-L-ETA is selected from the group consisting of:

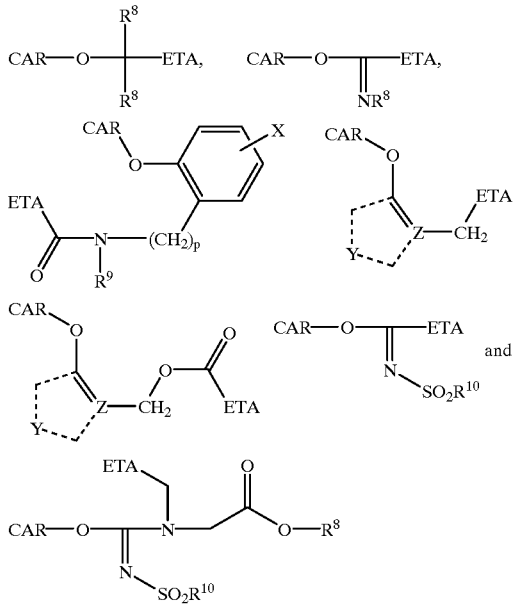

wherein $R^8$ is independently a hydrogen, a substituted or unsubstituted alkyl group having 1 to 12 carbon atoms, or a substituted or unsubstituted aryl group having 6 to 10 carbon atoms;

$R^9$ is a substituted or unsubstituted alkyl group having from 1 to 20 carbon atoms, or a substituted or unsubstituted aryl group having from 6 to 20 carbon atoms;

X is $—NO_2$, —CN, sulfone, sulfonamide, halogen or alkoxycarbonyl and p is 0 or 1;

$R^{10}$ is a substituted or unsubstituted alkyl or aryl group;

Y represents the atoms necessary to form a substituted or unsubstituted carbocyclic aromatic ring, or a substituted or unsubstituted heterocyclic aromatic ring wherein the double bond is incorporated as part of the aromatic ring; and Z is a carbon or nitrogen atom.

3. The photographic element of claim 2 wherein CAR—L—ETA is represented by the following formulas:

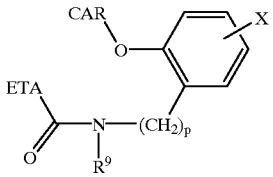

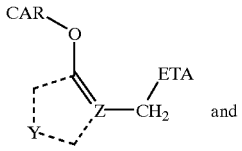

and

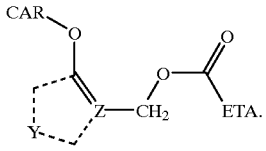

wherein Z is a carbon atom and Y represents the atoms necessary to form a substituted or unsubstituted phenyl ring.

4. The photographic element of claim 1 wherein ETA is selected from the group consisting of

I

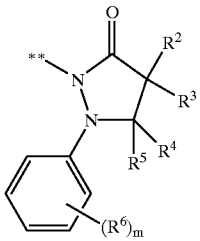

and

II

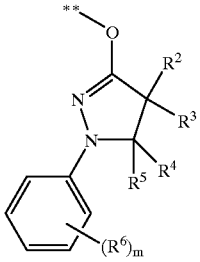

**denotes point of attachment to CAR—$(L)_n$—;

wherein:

$R^2$ and $R^3$ each independently represent hydrogen, a substituted or unsubstituted alkyl group having from 1 to 12 carbon atoms, $CH_2OR^7$ or $CH_20C(O)R^7$ where $R^7$ is a substituted or unsubstituted alkyl, aryl or a heteroatom containing group;

$R^4$ and $R^5$ each independently represent hydrogen, a substituted or unsubstituted alkyl group having from 1 to 8 carbon atoms or a substituted or unsubstituted aryl group having from 6 to 10 carbon atom;

$R^6$ is a substituent; and m is 0 to 5; wherein when m is greater than 1, the $R^6$ substituents may form a carbocyclic or heterocyclic ring.

5. The photographic element of claim 4 wherein $R^2$ and $R^3$ are alkyl, $CH_2OR^7$ or $CH_2OC(O)R^7$ groups containing 3 to 8 carbon atoms; $R^4$ and $R^5$ are hydrogen, $R^6$ is independently a halogen, a substituted or unsubstituted alkyl group having from 1 to 8 carbon atoms, a substituted or unsubstituted alkoxy group having from 1 to 8 carbon atoms, an amido, sulfonamido, ester, cyano, sulfone, carbamoyl, uriedo group, or a heteroatom containing group or ring.

6. The photographic element of claim 4 wherein $R^4$ and $R^5$ are hydrogen; and $R^2$, $R^3$ and $R^6$ are as represented in the following Table:

TABLE

| ETA No. | $R^2$ | $R^3$ | $R^6$ |
|---|---|---|---|
| 1 | $CH_3$ | $CH_2OC(O)iPr$ | H |
| 2 | $CH_3$ | $CH_2OC(O)tBu$ | H |
| 3 | $CH_3$ | $CH_2OC(O)Et$ | p-$CH_3$ |
| 4 | $CH_3$ | $CH_2OC(O)Et$ | 3,4-dimethyl |
| 5 | H | $CH_2OC_4H_9$-n | p-$OCH_3$ |
| 6 | $CH_3$ | $CH_2OC(O)CH_2$—O—$(CH_2)_2S(CH_2)_2SMe$ | H |

7. The photographic element of claim 2 wherein ETA is selected from the group consisting of

I

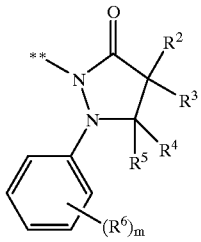

and

II

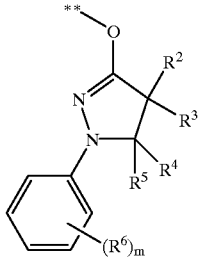

**denotes point of attachment to CAR—$(L)_n$—;

wherein:

$R^2$ and $R^3$ each independently represent hydrogen, a substituted or unsubstituted alkyl group having from 1 to 12 carbon atoms, $CH_2OR^7$ or $CH_20C(O)R^7$ where $R^7$ is a substituted or unsubstituted alkyl, aryl or a heteroatom containing group;

$R^4$ and $R^5$ each independently represent hydrogen, a substituted or unsubstituted alkyl group having from 1 to 8 carbon atoms or a substituted or unsubstituted aryl group having from 6 to 10 carbon atom;

$R^6$ is independently a substituent; and m is 0 to 5 wherein when m is greater than 1, the $R^6$ substituents may form a carbocyclic or heterocyclic ling.

8. The photographic element of claim 7 wherein $R^2$ and $R^3$ are alkyl, $CH_2OR^7$ or CH20C(O)$R^7$ groups containing 3 to 8 carbon atoms; $R^4$ and $R^5$ are hydrogen; and $R^6$ is independently a halogen, a substituted or unsubstituted alkyl group having from 1 to 8 carbon atoms, a substituted or unsubstituted alkoxy group having from 1 to 8 carbon atoms, an amido, sulfonamido, ester, cyano, sulfone, carbamoyl, uriedo group, or a heteroatom containing group or ring.

9. The photographic element of claim 7 wherein $R^4$ and $R^5$ are hydrogen; and $R^2$, $R^3$ and $R^6$ are as represented in the following Table:

TABLE

| ETA No. | $R^2$ | $R^3$ | $R^6$ |
|---|---|---|---|
| 1 | $CH_3$ | $CH_2OC(O)iPr$ | H |
| 2 | $CH_3$ | $CH_2OC(O)tBu$ | H |
| 3 | $CH_3$ | $CH_2OC(O)Et$ | p-$CH_3$ |
| 4 | $CH_3$ | $CH_2OC(O)Et$ | 3,4-dimethyl |
| 5 | H | $CH_2OC_4H_9$-n | p-$OCH_3$ |
| 6 | $CH_3$ | $CH_2OC(O)CH_2$—O—$(CH_2)_2S(CH_2)_2SMe$ | H |

10. The photographic element of claim 1 wherein CAR is a coupler moiety.

11. The photographic element of claim 7 wherein CAR is a coupler moiety.

12. The photographic element of claim 1 wherein the carrier moiety is a phenol or naphthol coupler moiety.

13. The photographic element of claim 11 wherein the coupler moiety is a phenol or naphthol coupler moiety.

14. The photographic element of claim 1 wherein the soluble mercaptan releasing coupler is represented by the formula $$A—(L)_n—S—R—(SOL)_i$$

wherein A is a coupling moiety which upon reaction with oxidized developer releases —$(L)_n$—S—R—SOL;

L is a divalent releasing or timing group;

n is 0, 1 or 2;

R is an alkyl group or aryl group containing 8 or less carbon atoms, or is a 5 or 6-membered heterocyclic ring.

SOL is a water solubilizing group and i is 1, 2 or 3.

15. The photographic element of claim 14 wherein A is a phenol or naphthol moiety; R is an alkyl group containing 8 or less carbon atoms and SOL is a carboxy group.

16. The photographic element of claim 15 wherein the soluble mercaptan releasing compound is

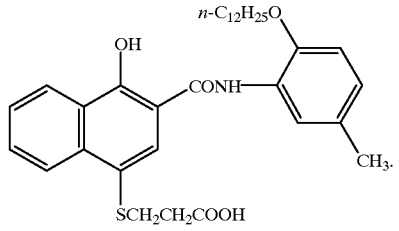

17. The photographic element of claim 10 wherein the coupler moiety is selected from the group consisting of:

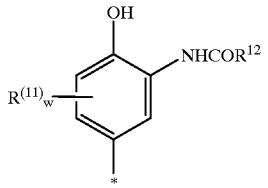

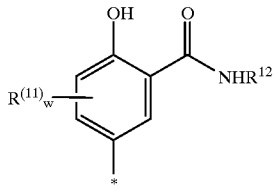

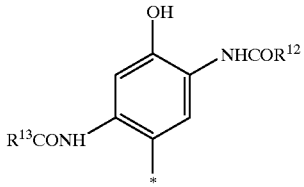

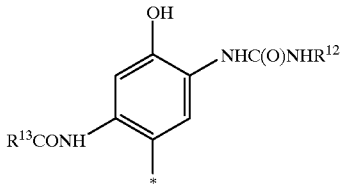

and

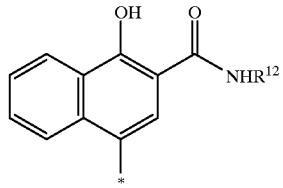

* denotes link to —$(L)_n$—ETA where $R^{12}$ and $R^{13}$ are a ballast group, a hydrogen, or a substituted or unsubstituted alkyl or aryl group, $R^{11}$ is a halogen atom, an alkyl group having from 1 to 4 carbon atoms or an alkoxy group having from 1 to 4 carbon atoms, and w is 1 or 2.

18. The photographic element of claim 1 wherein the at least one emulsion layer further comprises an image dye-forming coupler compound.

19. The photographic element of claim 1 wherein the c log P is between and includes 2.40 and 3.50.

20. A photographic element comprising a support and at least two silver halide emulsion layers wherein at least one emulsion layer contains (a) an image dye-forming coupler compound;

(b) at least one soluble mercaptan releasing compound; and (c) an electron transfer agent releasing compound represented by the formula:

$$CAR—(L)_n—ETA$$

wherein:

CAR is a is a phenol or naphthol coupler moiety which is capable of releasing —$(L)_n$—ETA on reaction with oxidized developing agent;

and CAR—L—ETA is selected from the group consisting of:

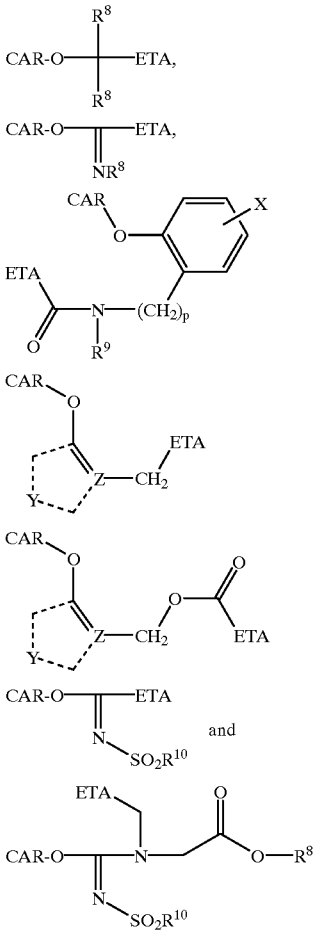

wherein $R^8$ is independently a hydrogen, a substituted or unsubstituted alkyl group having 1 to 12 carbon atoms, or a substituted or unsubstituted aryl group having 6 to 10 carbon atoms;

$R^9$ is a substituted or unsubstituted alkyl group having from 1 to 20 carbon atoms, or a substituted or unsubstituted aryl group having from 6 to 20 carbon atoms;

X is —$NO_2$, —CN, sulfone, sulfonamide, halogen or alkoxycarbonyl and p is 0 or 1;

$R^{10}$ is a substituted or unsubstituted alkyl or aryl group;

Z is a carbon or nitrogen atom and Y represents the atoms necessary to form a substituted or unsubstituted carbocyclic aromatic ring, or a substituted or unsubstituted heterocyclic aromatic ring wherein the double bond is incorporated as part of the aromatic ring;

ETA is a releasable 1-aryl-3-pyrazolidinone electron transfer agent having a calculated log partition coefficient (c log P) greater than or equal to 2.40 wherein ETA is selected from the group consisting of:

I

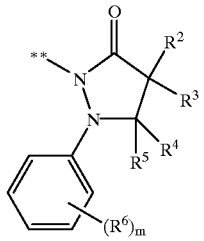

and

II

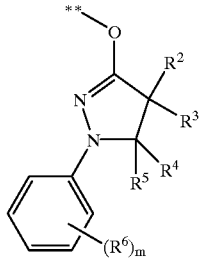

**denotes point of attachment to CAR—$(L)_n$—;

wherein:

$R^2$ and $R^3$ each independently represent hydrogen, a substituted or unsubstituted alkyl group having from 1 to 12 carbon atoms, $CH_2OR^7$ or $CH_2OC(O)R^7$ where $R^7$ is a substituted or unsubstituted alkyl, aryl or a heteroatom containing group;

$R^4$ and $R^5$ each independently represent hydrogen, a substituted or unsubstituted alkyl group having from 1 to 8 carbon atoms or a substituted or unsubstituted aryl group having from 6 to 10 carbon atom;

$R^6$ is independently a substituent; and m is 0 to 5 wherein when m is greater than 1, the $R^6$ substituents may form a carbocyclic or heterocyclic ring.

21. The photographic element of claim 20 wherein $R^2$ and $R^3$ are alkyl, $CH_2OR^7$ or $CH_2OC(O)R^7$ groups containing 3 to 8 carbon atoms; $R^4$ and $R^5$ are hydrogen; and $R^6$ is independently a halogen, a substituted or unsubstituted alkyl group having from 1 to 8 carbon atoms, a substituted or unsubstituted alkoxy group having from 1 to 8 carbon atoms, an amido, sulfonamido, ester, cyano, sulfone, carbamoyl, uriedo group, or a heteroatom containing group or ring.

22. The photographic element of claim 20 wherein $R^4$ and $R^5$ are hydrogen; and $R^2$, $R^3$ and $R^6$ are as represented in the following Table:

TABLE

| ETA No. | $R^2$ | $R^3$ | $R^6$ |
|---|---|---|---|
| 1 | $CH_3$ | $CH_2OC(O)iPr$ | H |
| 2 | $CH_3$ | $CH_2OC(O)tBu$ | H |
| 3 | $CH_3$ | $CH_2OC(O)Et$ | p-$CH_3$ |
| 4 | $CH_3$ | $CH_2OC(O)Et$ | 3,4-dimethyl |

TABLE-continued

| ETA No. | $R^2$ | $R^3$ | $R^6$ |
|---|---|---|---|
| 5 | H | $CH_2OC_4H_9$-n | p-$OCH_3$ |
| 6 | $CH_3$ | $CH_2OC(O)CH_2$—O—$(CH_2)_2S(CH_2)_2SMe$ | H |

23. The photographic element of claim 20 wherein the coupler moiety is selected from the group consisting of:

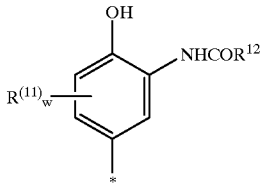

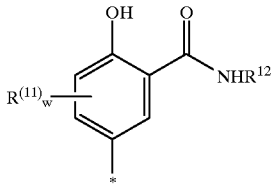

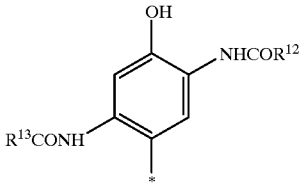

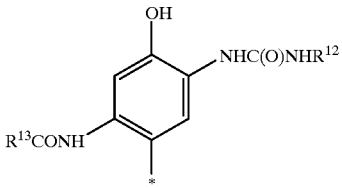

and

-continued

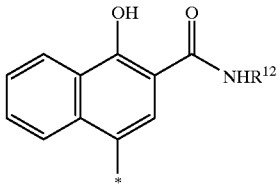

* denotes link to —$(L)_n$—ETA where $R^{12}$ and $R^{13}$ are a ballast group, a hydrogen, or a substituted or unsubstituted alkyl or aryl group, $R^{11}$ represents a halogen atom, an alkyl group having from 1 to 4 carbon atoms or an alkoxy group having from 1 to 4 carbon atoms and w is 1 or 2.

24. The photographic element of claim 20 wherein the soluble mercaptan releasing coupler is represented by the formula $$A—(L)_n—S—R—(SOL)_i$$

wherein A is a coupling moiety which upon reaction with oxidized developer releases —(L)—S—R—SOL;

L is a divalent releasing or timing group;

n is 0, 1 or2;

R is an alkyl group or aryl group containing 8 or less carbon atoms, or is a 5 or 6-membered heterocyclic ring.

SOL is a water solubilizing group and i is 1, 2 or 3.

25. The photographic element of claim 24 wherein A is a phenol or naphthol moiety; R is an alkyl group containing 8 or less carbon atoms and SOL is a carboxy group.

26. The photographic element of claim 25 wherein the soluble mercaptan releasing compound is

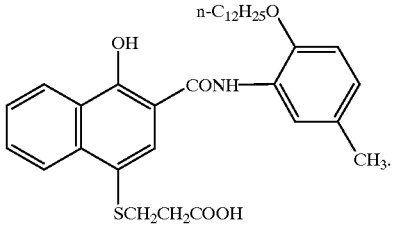

27. The photographic element of claim 20 wherein the c log P is between and includes 2.40 and 3.50.

* * * * *